US006745685B2

(12) United States Patent
Kinoshita et al.

(10) Patent No.: US 6,745,685 B2
(45) Date of Patent: Jun. 8, 2004

(54) STENCIL PRINTING DEVICE

(75) Inventors: Hideyuki Kinoshita, Tokyo (JP); Taku Naitou, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 164 days.

(21) Appl. No.: 10/030,716

(22) PCT Filed: May 17, 2001

(86) PCT No.: PCT/JP01/04095

§ 371 (c)(1),
(2), (4) Date: Jan. 31, 2002

(87) PCT Pub. No.: WO01/87630

PCT Pub. Date: Nov. 22, 2001

(65) Prior Publication Data

US 2002/0112621 A1 Aug. 22, 2002

(30) Foreign Application Priority Data

May 17, 2000 (JP) ..... 2000-145267
Oct. 31, 2000 (JP) ..... 2000-332883

(51) Int. Cl.[7] ..... B41L 13/04; B65H 5/22

(52) U.S. Cl. ..... 101/118; 101/116; 271/197; 271/196

(58) Field of Search ..... 101/116, 117, 101/118, 119, 120, 124, 126, 129, 114; 271/195, 196, 197, 276; 198/689.1, 471.1

(56) References Cited

U.S. PATENT DOCUMENTS 5,673,619 A * 10/1997 Ohinata et al. ..... 101/116
5,967,510 A * 10/1999 Ono et al. ..... 271/196

FOREIGN PATENT DOCUMENTS

| | | |
|---|---|---|
| JP | 57-184054 | * 11/1982 |
| JP | 60-148866 | 8/1985 |
| JP | 3-26571 | 3/1991 |
| JP | 8-192565 | 7/1996 |
| JP | 8-318669 | 12/1996 |
| JP | 11-129599 | 5/1999 |
| JP | 11-151852 | 6/1999 |
| JP | 11-180020 | 7/1999 |
| JP | 2000-103155 | 4/2000 |

* cited by examiner

*Primary Examiner*—Leslie J. Evanisko
(74) *Attorney, Agent, or Firm*—Kanesaka & Takeuchi

(57) ABSTRACT

A stencil printing machine having an exfoliation suction apparatus including a case having a guide plate at its upper face, a suction force generating portion provided at the case and an exfoliation suction port provided at one end portion of the guide plate for constituting suction force for exfoliating print sheet from a printing drum by suction force by the suction force generating portion in which the exfoliation suction port is arranged to be proximate to a press roller orthgonally to a center line of a squeegee roller intersecting with an axis line of the printing drum and on a lower side of a reference line passing through a position of bringing the press roller and into press contact with the printing drum.

10 Claims, 21 Drawing Sheets

STENCIL PRINTING DEVICE

BACKGROUND OF THE INVENTION AND RELATED ART STATEMENT

The present invention relates to a stencil printing machine having a sheet transfer apparatus for discharging sheet formed with an image.

FIG. 21 shows a general stencil printing machine.

On one side of the stencil printing machine, there is provided a sheet supply base 100 loaded with print sheet P. The print sheet P is supplied to inside of the stencil printing machine by separating only a topmost sheet thereof by a separating roller 101.

The supplied print sheet P is transferred to a side of a printing drum 103 provided at inside of the stencil printing machine at predetermined timings by register rollers 102.

The printing drum 103 is constituted by forming an ink-permeable peripheral wall 104 in a cylindrical shape and is rotated in the counterclockwise direction of FIG. 21 around an axis line of the printing drum 103 per se. A perforated stencil sheet is wound around an outer peripheral face of the printing drum 103. At an inner portion of the printing drum 103, there is provided ink supply means 105 for supplying ink to an inner peripheral face of the printing drum 103. At outside of the printing drum 103, there is provided a press roller 106 moved attachably to and detachably from the outer peripheral face of the printing drum 103 at a position opposed to the ink supplying means 105.

Further, the print sheet P transferred by the register rollers 102, is brought into press contact with the stencil sheet disposed on the outer peripheral face of the printing drum 103 by the press roller 106 and one face thereof is transcribed with ink extruded from the inner peripheral face of the printing drum 103 via perforated portions of the stencil sheet.

The printed print sheet P is transferred by rotation of the printing drum 103 and is discharged to a sheet discharge base 109 provided on other side (side opposed to the sheet supply base 100) of the stencil printing machine by a sheet transfer apparatus according to a vacuum conveyor (suction belt) system having a vacuum fan 107 and a sheet transfer belt 108. A series of printing operation is carried out in this way.

In the above-described series of printing operation, the print sheet P brought into press contact to the side of the printing drum 103 by the press roller 106, is pasted to the side of the stencil sheet disposed on the outer peripheral face of the printing drum 103 by adhering force of ink.

Hence, conventionally, there is provided a separating claw 110 having a sharpened front end in front of the sheet transfer apparatus disposed on a sheet transferring side of the printing drum 103. The separating claw 110 catches the print sheet P pasted to the side of the printing drum 103 to thereby separate the print sheet P from the side of the printing drum 103.

Further, conventionally, in addition to (or in place of) the separating claw 110, there is provided an air blow fan 111 in front of the sheet transfer apparatus disposed on the sheet transferring side of the printing drum 103. By air blowing force of the air blow fan 111, the print sheet P is separated from the side of the printing drum 103.

However, according to the above-described conventional stencil printing machine, in the case of the separating claw 110, when the print sheet P is separated from the side of the printing drum 103, the separating claw 110 is brought into direct contact with the printed image face of the print sheet P and therefore, there poses a problem that an image portion is scraped and print quality is deteriorated.

Further, in the case of the air blow fan 111, there is produced a negative pressure region on the downstream side of an air flow at a vicinity of a blow out port thereof. Further, when the print sheet P is separated from the side of the printing drum 103, the print sheet P to be directed to the side of the sheet transfer apparatus, may be attracted to the side of the air blow fan 111 by suction operation of the negative pressure region and brought into contact with the blow out port of the air blow fan 111. Thereby, the image portion of the print sheet P is scraped similar to the case of the separating claw 110 and there poses a problem that the print quality is deteriorated.

Meanwhile, when a printing rate of the print image is large, that is, when a solid portion is large, the adhering force of ink is increased and the print sheet P becomes difficult to separate from the side of the printing drum 103. That is, time of separating the print sheet P from the side of the printing drum 103 is retarded and a time period of holding the print sheet P on the side of the printing drum 103 is prolonged.

Thereby, for example, although a transfer front end side of the print sheet P is going to be separated and transferred by the sheet transfer apparatus, a transfer rear end side thereof remains at the side of the printing drum 103 air without being separated from the side of the printing drum 103. Therefore, there poses a problem that the transfer rear end side of the print sheet P is flown up and in the worst case, sheet discharge jam is caused and the printing operation is interrupted.

Further, when the printing rate differs on the left and right sides of a direction of transferring the print sheet P, time of separating the print sheet P from the side of the printing drum 103 differs on the left side and on the right side. Thereby, there is a concern that transmission of the print sheet P to discharge is meandered or the sheet discharge jam is caused by the meandering.

Further, ink forms a printed image mainly by a mode of permeating to the print sheet P. However, when the time period of holding the print sheet P on the side of the printing drum 103, is long as mentioned above, ink of an amount more than necessary is transcribed to the print sheet P by the capillary phenomenon of ink.

When an amount of transcribing ink is as much as more than necessary in this way, the printed image portion is blotted to thereby deteriorate print quality or gradation is produced at a solid portion. Further, there causes a drawback that excess ink remaining on the surface of the print sheet P without being permeated, is brought into contact with a rear face of the print sheet P to be discharged successively and setoff is caused.

Although in each stencil sheet, the printing rate of the printed image respectively differs variously, when the printing rate differs considerably, a timing of separating the print sheet P from the side of the printing drum 103 differs.

That is, when the transfer front end side of the print sheet P is separated to the side of the sheet transfer apparatus, a track of exfoliating the transfer front end is changed and a position of the front end of the sheet is changed. Further, when the printing rate differs on the left side and on the right side of the transfer direction of the print sheet P, the print sheet P meanders as mentioned above and therefore, when the transfer front end side of the print sheet P is separated to the side of the sheet transfer apparatus, the position of the front end of the sheet meanders.

When the position of the front end of the print sheet P is changed in this way, particularly in the case of a stencil printing machine for carrying out multiple block printing or double-faced printing by providing other printing drum (not illustrated) at a post stage of the printing drum 103, there poses a problem that a printed image printed by the post stage of the printing drum shifts relative to the image of the print sheet P printed by the printing drum 103 at the initial stage.

Hence, in order to resolve the above-described problem, it is an object of the invention to provide a stencil printing machine capable of separating print sheet from a side of a printing drum and capable of separating print sheet from the side of the printing drum to align a position of a front end of sheet, regardless of a printing rate of printing and without being brought into contact with a printed image face of print sheet.

SUMMARY OF THE INVENTION

An explanation will be given of a constitution of the invention in order to achieve the above-described object in reference to the drawings in correspondence with embodiments.

That is, according to a first aspect of the invention, there is provided a stencil printing machine comprising:

a printing drum having an ink-permeable peripheral wall in a cylindrical shape and made rotatable around an axis line of the printing drum per se;

a squeegee roller for supplying ink from an inner peripheral face of the peripheral wall;

a press roller provided at outside of the printing drum for bringing a print sheet into press contact with a stencil sheet wound around an outer peripheral face of the peripheral wall between the squeegee roller and the press roller; and exfoliation suction means for sucking the print sheet so as to exfoliate the print sheet from the printing drum;

the exfoliation suction means comprising:

a case having a guide plate at an upper face thereof and an exfoliation suction port at one end portion of the guide plate, the exfoliation suction port being arranged to be proximate to the press roller on a lower side of a reference line, the reference line being orthogonal to a center line of the squeegee roller intersecting with the axis line of the printing drum and passing through a position of bringing the press roller and the side of the printing drum into press contact with each other; and a suction force generating portion for generating suction force to suck the print sheet toward the exfoliation suction port so as to exfoliate the print sheet from the printing drum, the suction force generating portion being provided at the case.

According to a second aspect of the invention, there is provided the stencil printing machine according to the first aspect wherein the suction force generating portion is provided to be proximate to a side of the exfoliation suction port.

According to a third aspect of the invention, there is provided the stencil printing machine according to the first aspect wherein the exfoliation suction port is provided at an upper end edge of the case constituting the one end portion side of the guide plate, and the exfoliation suction means further comprises a transfer section for transferring the print sheet, the transfer section having:

one pulley disposed at a vicinity of the exfoliation suction port in the case and axially supported by one end portion side of the guide plate;

the other pulley axially supported by other end portion side of the guide plate;

a support shaft provided at an opening portion of the exfoliation suction port; and a transfer belt formed in an endless shape and hung around the pulleys and the support shaft so as to enter from the exfoliation suction port into the case;

the transfer section for driving an upper side portion of the transfer belt along an upper face of the guide plate.

According to a fourth aspect of the invention, there is provided the stencil printing machine according to the first aspect wherein the exfoliation suction means further comprises:

a transfer section for hanging a transfer belt formed in an endless shape around a pair of pulleys axially supported by one end portion side and other end portion side of the guide plate so as to drive an upper side portion of the transfer belt along an upper face of the guide plate; and a guide rib for supporting the print sheet exfoliated from the side of the printing drum at the exfoliation suction port without bending the print sheet so as to guide the print sheet toward the transfer belt.

According to a fifth aspect of the invention, there is provided the stencil printing machine according to the first aspect wherein a plurality of the printing drums are provided via the exfoliation suction means.

According to a sixth aspect of the invention, there is provided a stencil printing machine comprising:

a printing drum having an ink-permeable peripheral wall in a cylindrical shape and made rotatable around an axis line of the printing drum per se;

a squeegee roller for supplying ink from an inner peripheral face of the peripheral wall;

a press roller provided at outside of the printing drum for bringing a print sheet into press contact with a stencil sheet wound around an outer peripheral face of the peripheral wall between the squeegee roller and the press roller;

suction transfer means for sucking the print sheet so as to exfoliate the print sheet from the printing drum to thereby transfer the print sheet, the suction transfer means comprising: a case having a guide plate at an upper face thereof and an exfoliation suction port provided at one end portion of the guide plate, the exfoliation suction port being arranged to be proximate to the press roller on a lower side of a reference line, the reference line being orthogonal to a center line of the squeegee roller intersecting with the axis line of the printing drum and passing through a position of bringing the press roller and a side of the printing drum into press contact with each other; a suction force generating portion for generating suction force, the suction force generating portion being provided at the case; and a transfer section for transferring the print sheet, the transfer section having: one pulley disposed at a vicinity of the exfoliation suction port and axially supported by one end portion side of the guide plate; the other pulley axially supported by other end portion side of the guide plate; and an endless shaped transfer belt with a vent hole formed therein hung around the pulleys so as to enter from the exfoliation suction port into the case, the transfer section driving an upper side portion of the transfer belt along an upper face of the guide plate;

wherein the guide plate has a transfer suction port overlapping the vent hole of the transfer belt, and the suction force generating portion generates suction force for sucking the print sheet toward the exfoliation suction port so as to exfoliate the print sheet from the printing drum and for sucking the exfoliated print sheet toward the vent hole and the transfer suction port overlapped each other so as to adsorb the exfoliated print sheet onto the transfer belt.

According to a seventh aspect of the invention, there is provided the stencil printing machine according to the sixth aspect wherein the suction force generating portion is provided to be proximate to a side of the exfoliation suction port.

According to an eighth aspect of the invention, there is provided the stencil printing machine according to the sixth aspect wherein the exfoliation suction port is provided at an upper end edge of the case constituting the one end portion side of the guide plate, the one pulley is disposed in the case, the transfer section has a support shaft provided at an opening portion of the exfoliation suction port, and the transfer belt is hung around the pulleys and the support shaft so as to enter from the exfoliation suction port into the case.

According to a ninth aspect of the invention, there is provided the stencil printing machine according to the sixth aspect wherein said stencil printing machine is formed such that a total opening area of the transfer suction port is smaller than a total opening area of the exfoliation suction port.

According to a tenth aspect of the invention, there is provided the stencil printing machine according to the sixth aspect wherein the suction transfer means is provided with a guide rib for supporting the print sheet exfoliated from the side of the printing drum at the exfoliation suction port without bending the print sheet so as to guide the print sheet toward the transfer belt.

According to an eleventh aspect of the invention, there is provided the stencil printing machine according to the sixth aspect wherein a plurality of the printing drums are provided via the suction transfer means.

BRIEF DESCRIPTION OF THE DRAWINGS

FIG. 2(*b*) is a side view of FIG. 2(*a*);

FIG. 3(*b*) is a side view of FIG. 3(*a*);

FIG. 4(*b*) is a side view of FIG. 4(*a*);

FIG. 16(*b*) is a side view of FIG. 16(*a*);

FIG. 17(*b*) is a side view of FIG. 17(*a*);

FIG. 18(*b*) is a side view of FIG. 18(*a*);

DETAILED DESCRIPTION OF PREFERRED EMBODIMENTS

A specific explanation will be given of embodiments of the invention in reference to the drawings as follows.

Figure 1:
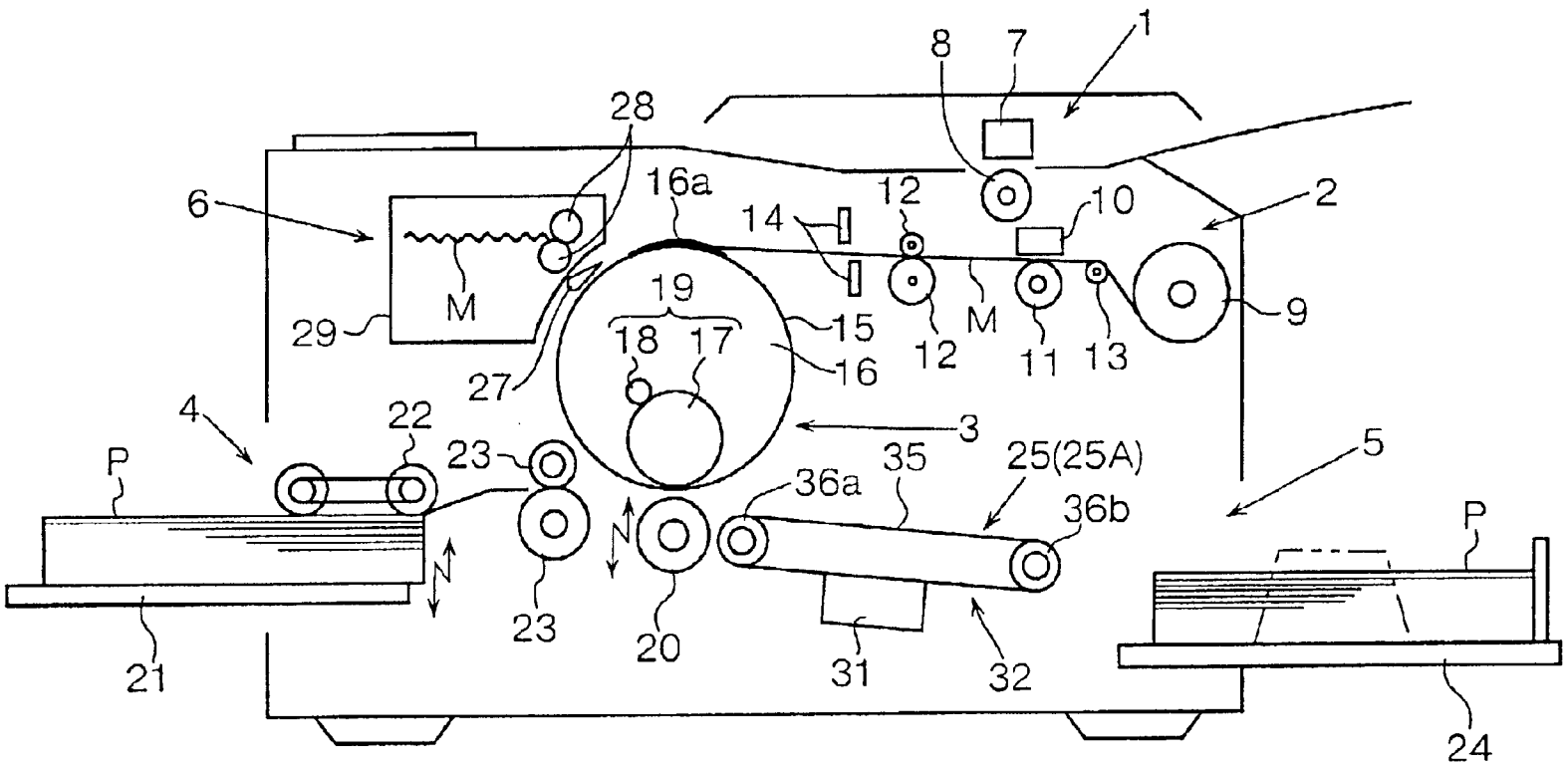
FIG. 1 is a side view showing an example of a stencil printing machine according to the invention.

FIG. 1 is a side view showing an example of a stencil printing machine according to the invention.

The stencil printing machine is provided with an original document reading section 1, a stencil making section 2, a printing section 3, a sheet supply section 4, a sheet discharge section 5 and a stencil sheet discharge section 6.

The original document reading section 1, which is an image scanner, is provided with a line image sensor 7 for reading an image of original document transferred in a sub scanning direction and an original document feed roller 8.

Further, the original document reading section 1 is not limited to the above-described constitution but may be constituted to read an image of original document by moving the line image sensor 7 in the sub scanning direction relative to fixed original document. That is, the original document reading section 1 reads an image of original document by moving the original document and the line image sensor 7 relative to each other.

The stencil making section 2 is provided with a stencil sheet roll section 9, a thermal head 10 constituted by a plurality of pieces of dot-like heat generating bodies arranged transversely in one row, a platen roller 11 and stencil sheet feed rollers 12, a stencil sheet guide roller 13 and a stencil sheet cutter 14.

Further, by rotating the platen roller 11, stencil sheet M is continuously drawn from the stencil sheet roll section 9 and is transferred between the thermal head 10 and the platen roller 11.

The thermal head 10 is inputted with image data of original document read by the original document reading section 1. Further, by generating heat by the plurality of pieces of dot-like heat generating bodies of the thermal head 10 respectively individually and selectively, thermosensitive perforation is carried out on the thermosensitive stencil sheet M in a dot matrix style.

In the perforation, the stencil sheet M extracted from the stencil sheet roll section 9 by the platen roller 11, is exerted with desired tensile force by the stencil sheet guide roller 13 to thereby prevent occurrence of wrinkle or the like. Further, the stencil sheet M subjected to perforation is transferred further by the stencil sheet feed rollers 12 and is cut to one printing block by the stencil sheet cutter 14.

The printing section 3 is provided with a printing drum 16 arranged with an ink-permeable peripheral wall 15 in a cylindrical shape. The wall 15 is formed in a porous structure constituted by a porous metal plate, a mesh structure body or the like. The printing drum 16 is driven to rotate in the counterclockwise direction of FIG. 1 around an axis line O of the printing drum 16 per se by driving means, not illustrated.

Further, an outer periphery of the printing drum 16 is provided with a clamp section 16*a* for clamping a front end portion of the stencil sheet M. Further, the printing drum 16 is windingly attached with the stencil sheet M on its outer peripheral face by being rotated while clamping the front end portion of the transferred and perforated stencil sheet M by the clamp portion 16*a*.

Further, at an inner portion of the printing drum 16, there is provided an ink supply apparatus 19 constituted by an squeegee roller (ink supply roller) 17 and a doctor roller 18. Further, on an outer side of the printing drum 16, there is provided a press roller 20 movably to be attachably to and detachably from an outer peripheral face of the printing drum 16 (peripheral wall 15).

The sheet supply section 4 is provided on one side of the printing section 3. The sheet supply section 4 is provided with a sheet supply base 21 loaded with print sheet P, a pickup roller 22 for taking out the print sheets P from the sheet supply base 21 sheet by sheet and sheet supply timing rollers 23 for feeding the print sheet P between the printing drum 16 and the press roller 20.

The sheet discharge section 5 is provided on the other side of the printing section 3. The sheet discharge section 5 is provided with a sheet discharge base 24 laminated with the printed print sheets P and suction transfer means 25 for exfoliating the print sheet P printed at the printing section 3 from the printing drum 16 and transferring the print sheet P to the sheet discharge base 24.

The stencil sheet discharge section 6 is provided on the one side of the printing section 3. The sheet discharge section 6 is provided with a separating claw 27 for separating the used stencil sheet M from the printing drum 16, stencil sheet discharge rollers 28 for transferring the separated stencil sheet M and a stencil discharge box 29 for containing the transferred stencil sheet M.

According to the stencil printing machine having the above-described constitution, a predetermined amount of ink is supplied to an inner peripheral face of the peripheral wall 15 of the printing drum 16 by the ink supply apparatus 19.

The printing drum 16 is driven to rotate in the counterclockwise direction of FIG. 1 around the axis line 0 of its own. The print sheet P is supplied between the printing drum 16 and the press roller 20 in a state of being moved from the left side to the right side of FIG. 1 by the sheet supply timing rollers 23 at predetermined timings in synchronism with rotation of the printing drum 16.

Further, by bringing the print sheet P into press contact with the stencil sheet M wound around the outer peripheral face of the printing drum 16 (peripheral wall 15) by moving the press roller 20, ink which has passed through the stencil sheet M from the printing drum 16 is transcribed onto the print sheet P to thereby carry out stencil printing.

An explanation will be given of the suction transfer means 25 of the sheet discharge portion 5 according to the stencil printing machine having the above-described constitution as follows.

Figure 2:
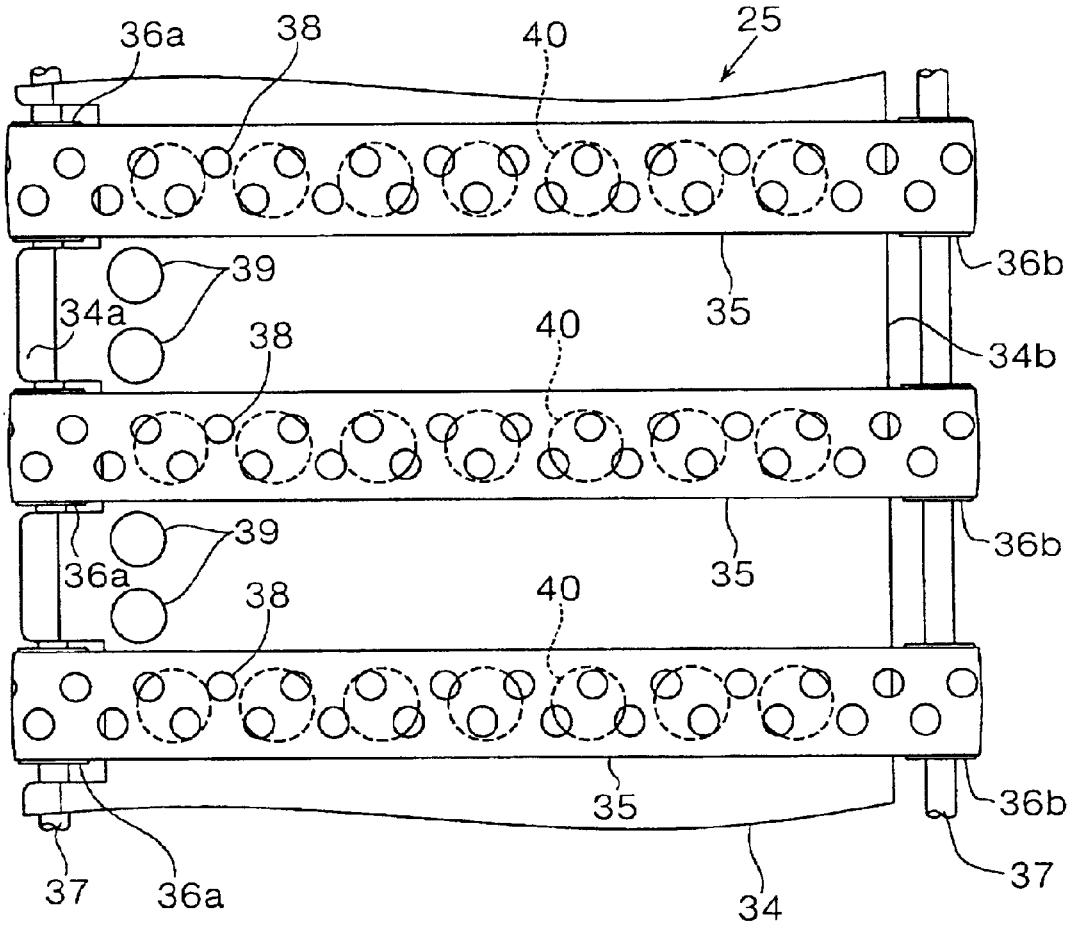
FIG. 2(*a*) is a plan view showing a first example of suction transfer means.
Figure 2:
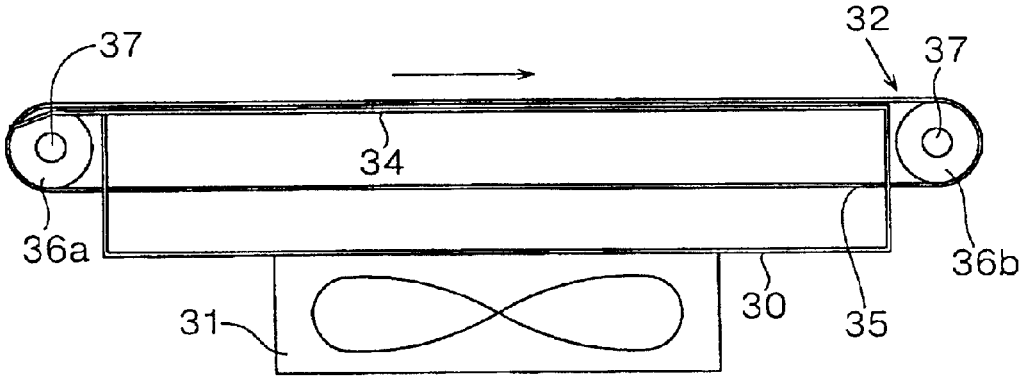

FIG. 2(*a*) is a plan view showing a first example of the suction transfer means 25 and FIG. 2(*b*) is a side view of FIG. 2(*a*).

As shown by FIGS. 2(*a*) and 2(*b*), the suction transfer means 25 is provided with a case 30 and a suction force generating section 31.

The case 30 is formed in a box-like shape having a guide plate 34 in a plate-like shape at its upper face. The guide plate 34 is formed substantially in a flat shape and is provided to direct one end portion 34*a* thereof to a side of the printing section 3 and direct other end portion 34*b* thereof to a side of the sheet discharge base 24.

The suction force generating section 31 is provided at a bottom face of the case 30. The suction force generating section 31 constitutes a suction fan according to the embodiment for exhausting air in the case 30 to a lower side at outside of the case 30.

The transfer section 32 is provided with a transfer belt 35 and a pair of pulleys 36*a* and 36*b*. The transfer belt 35 constitutes a strip member formed in an endless shape. The transfer belt 35 is hung around the pair of pulleys 36*a* and 36*b*. The transfer belt 35 is arranged such that an upper side thereof hung around the respective pulleys 36*a* and 36*b* is disposed along the upper face of the guide plate 34.

Further, the transfer belt 35 is provided with a vent holes 38. In FIG. 2(*a*), a plurality of the vent holes 38 are formed to open substantially in a circular shape at predetermined intervals.

The respective pulleys 36*a* and 36*b* are fixed to support shafts 37 respectively arranged to the side of the one end portion 34*a* and the side of the other end portion 34*b* of the guide plate 34 in parallel with each other.

A plurality (three pieces according to the invention) of the pulleys 36*a* and the pulleys 36*b* are fixed to the respective support shafts 37 opposedly to each other. The transfer belts 35 are hung around the pulleys 36*a* and 36*b* opposed to each other.

Further, one of the support shafts 37 constitutes a drive shaft and driven to rotate at predetermined speed by receiving rotational force from a drive motor not illustrated. The other of the shafts 37 constitutes a driven shaft rotatably supported.

Further, by driving to rotate the support shaft 37 constituting the drive shaft, the transfer belt 35 is rotated to circulate in an arrow mark direction of FIG. 2(*b*). Further, each of peripheral faces of the pulleys 36*a* and 36*b* are formed in a so-to-speak pot-bellied shape or barrel-like shape in which a central portion thereof is bulged more than both ends thereof to thereby prevent from meandering of the hung transfer belt 35.

At the one end portion 34*a* of the guide plate 34 directed to the side of the printing section 3, there are provided exfoliation suction ports 39. In FIG. 2(*a*), a plurality of the exfoliation suction ports 39 are formed to open substantially in a circular shape.

The exfoliation suction ports 39 are formed for sucking the printed print sheet P from the side of outer peripheral face of the printing drum 16 (peripheral wall 15) toward the exfoliation suction ports 39 to thereby exfoliate the printed print sheet P when the suction force generating portion 31 generates suction force.

Portions of the guide plate 34 overlapping the transfer belts 35 are provided with transfer suction ports 40. A plurality of the transfer suction ports 40 are formed to open substantially in a circular shape at equal intervals.

The transfer suction ports 40 overlap the vent holes 38 provided at the transfer belts 35. The print sheet P is adsorbed to the side of the transfer belt 35 by the suction force from the suction force generating section 31 when the exfoliation suction ports 40, and the vent holes 38 are overlapped each other. The print sheet P adsorbed to the transfer belt 35 is transferred in a direction of the sheet discharge base 24 constituting the arrow mark direction of FIG. 2(*b*) by rotating the transfer belt 35.

Further, the vent hole 38 provided at the transfer belt 35, the exfoliation suction port 39 and the transfer suction port 40 provided at the guide plate 34 are not limited to the above-described shape.

Figure 3:
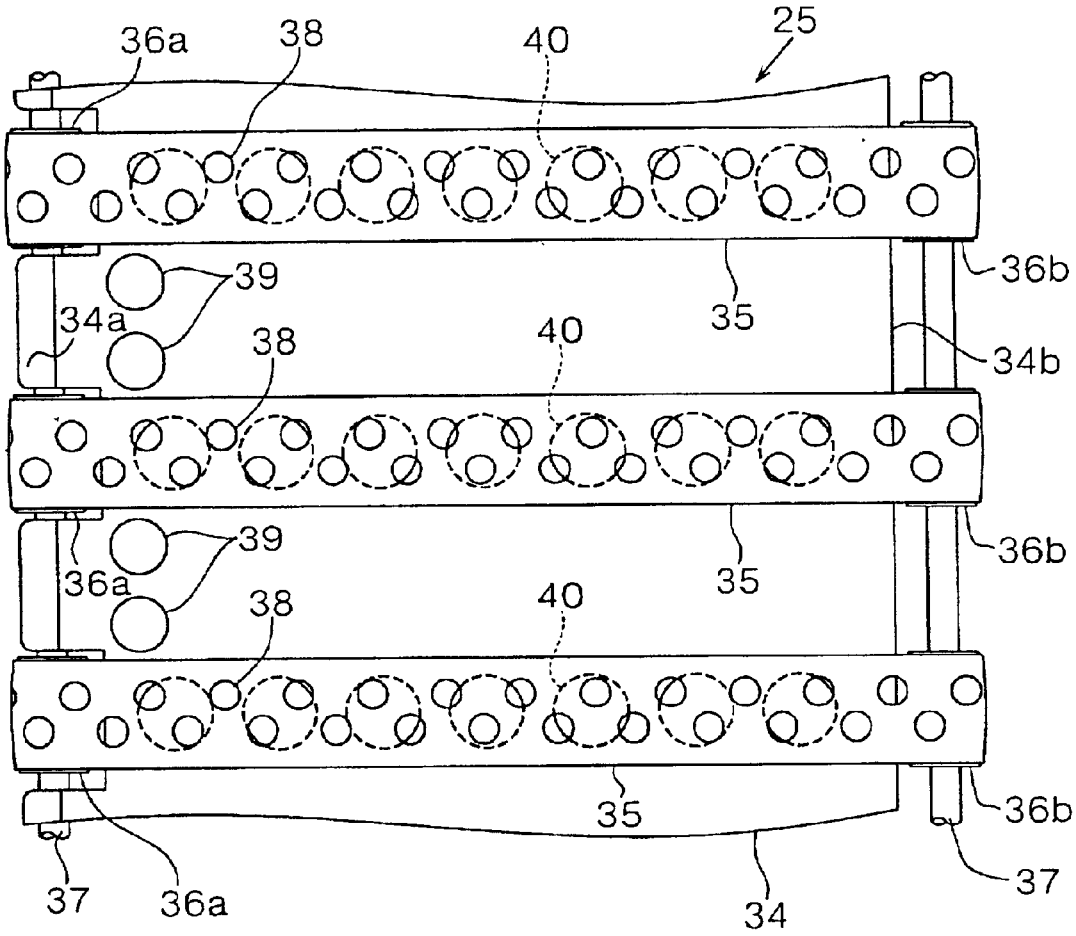
FIG. 3(*a*) is a plan view showing a second example of suction transfer means.
Figure 3:
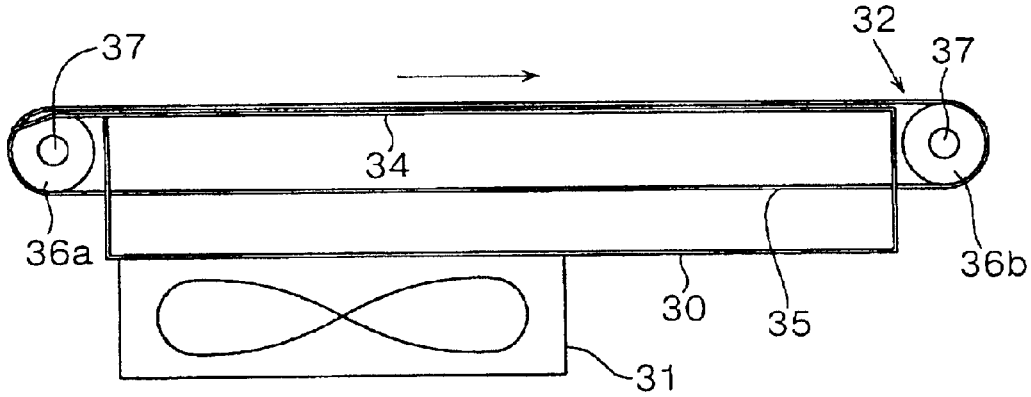

FIG. 3(*a*) is a plan view showing a second example of the suction transfer means and FIG. 3(*b*) is a side view of FIG. 3(*a*).

According to the suction transfer means 25 shown in FIGS. 3(*a*) and 3(*b*), in the suction transfer means 25 of the first example shown in FIGS. 2(*a*) and 2(*b*), the suction force generating portion 31 is arranged to be proximate to the exfoliation suction ports 39 constituting the side of the printing section 3.

Thereby, according to the suction transfer means 25 of the second example, the suction force on the side of the exfoliation suction ports 39 is made higher than the suction force on the side of the transfer suction ports 40 to thereby increase the suction force for exfoliating the printed print sheet P from the side of the outer peripheral face of the printing drum 16 (peripheral wall 15).

Figure 4:
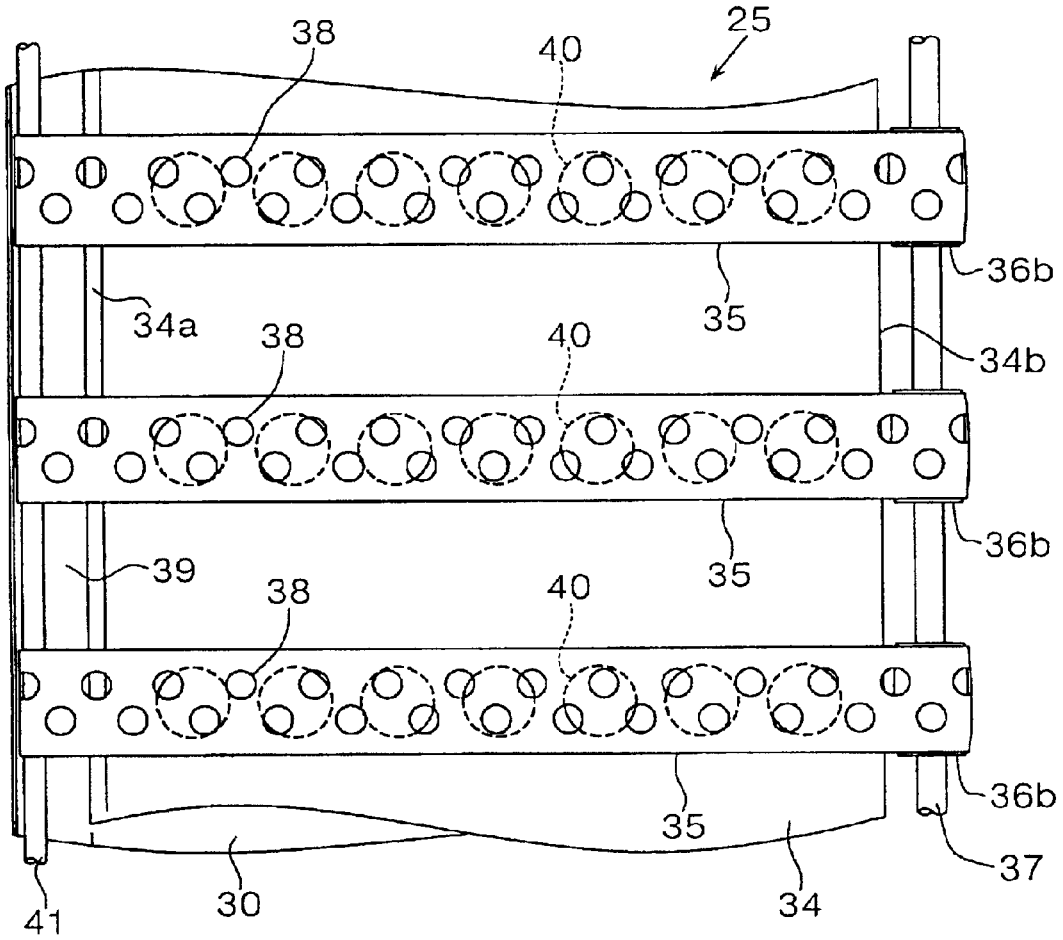
FIG. 4(*a*) is a plan view showing a third example of suction transfer means.
Figure 4:
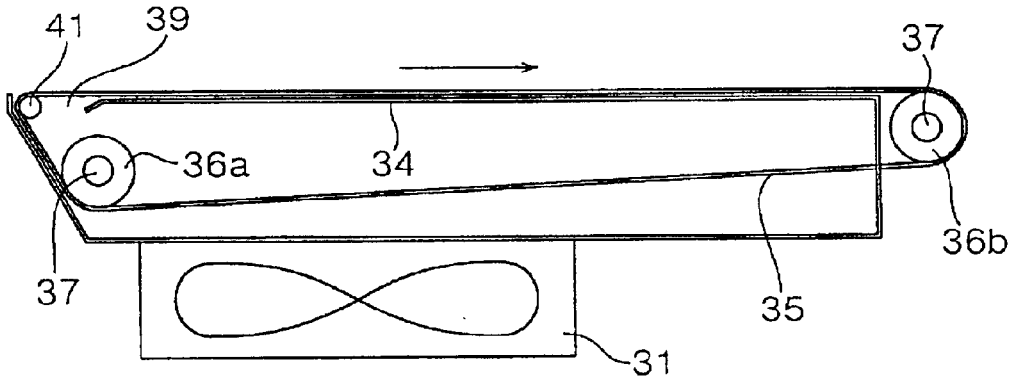

FIG. 4(*a*) is a plan view showing a third example of the suction transfer means and FIG. 4(*b*) is a side view of FIG. 4(*a*).

According to the suction transfer means 25 shown by FIGS. 4(*a*) and 4(*b*), with respect to the suction transfer means 25 of the second example shown by FIGS. 3(*a*) and 3(*b*), the exfoliation suction port 39 is provided at an upper end edge of the case 30 constituting the side of the one end portion 34*a* of the guide plate 34.

According to the embodiment, a gap is provided between the one end portion 34*a* of the guide plate 34 and the case 30 and the gap is made to constitute the exfoliation suction port 39.

Further, a front face of the case 30 provided with the exfoliation suction port 39 and directed to the side of the printing section 3, is formed inclinedly to the transfer direction of the print sheet P to thereby direct in a lower direction.

Further, the pulley 36*a* disposed on the side of the one end portion 34*a* of the guide plate 34 constituting a vicinity of the exfoliation suction port 39, is arranged at inside of the case 30.

Further, the transfer belt 35 hung around the respective pulleys 36*a* and 36*b*, is drawn from the exfoliation suction port 39 into the case 30.

Further, at an opening portion of the exfoliation suction port 39, there is provided a support shaft 41 for hanging the transfer belt 35. The support shaft 41 is formed by a diameter slenderer than diameters of the respective pulleys 36*a* and 36*b*. The support shaft 41 is in parallel with the support shafts 37 fixed with the respective pulleys 36*a* and 36*b*. The support shaft 41 is supported by the side of the case 30 to rotate along with rotation of the transfer belt 35.

Thereby, according to the suction transfer means 25 of the third example, the exfoliation suction port 39 is made more proximate to the portion at which the printing drum 16 and the press roller 20 are brought into press contact with each other to thereby sufficiently achieve suction operation by the exfoliation suction portion 39.

Further, according to the third example of the suction transfer means 25, by the transfer belt 35 extended to the opening portion of the exfoliation suction port 39, the printed print sheet P exfoliated from the side of the outer peripheral face of the printing drum 16 (peripheral wall 15) can immediately be transferred by the transfer belt 35.

Figure 5:
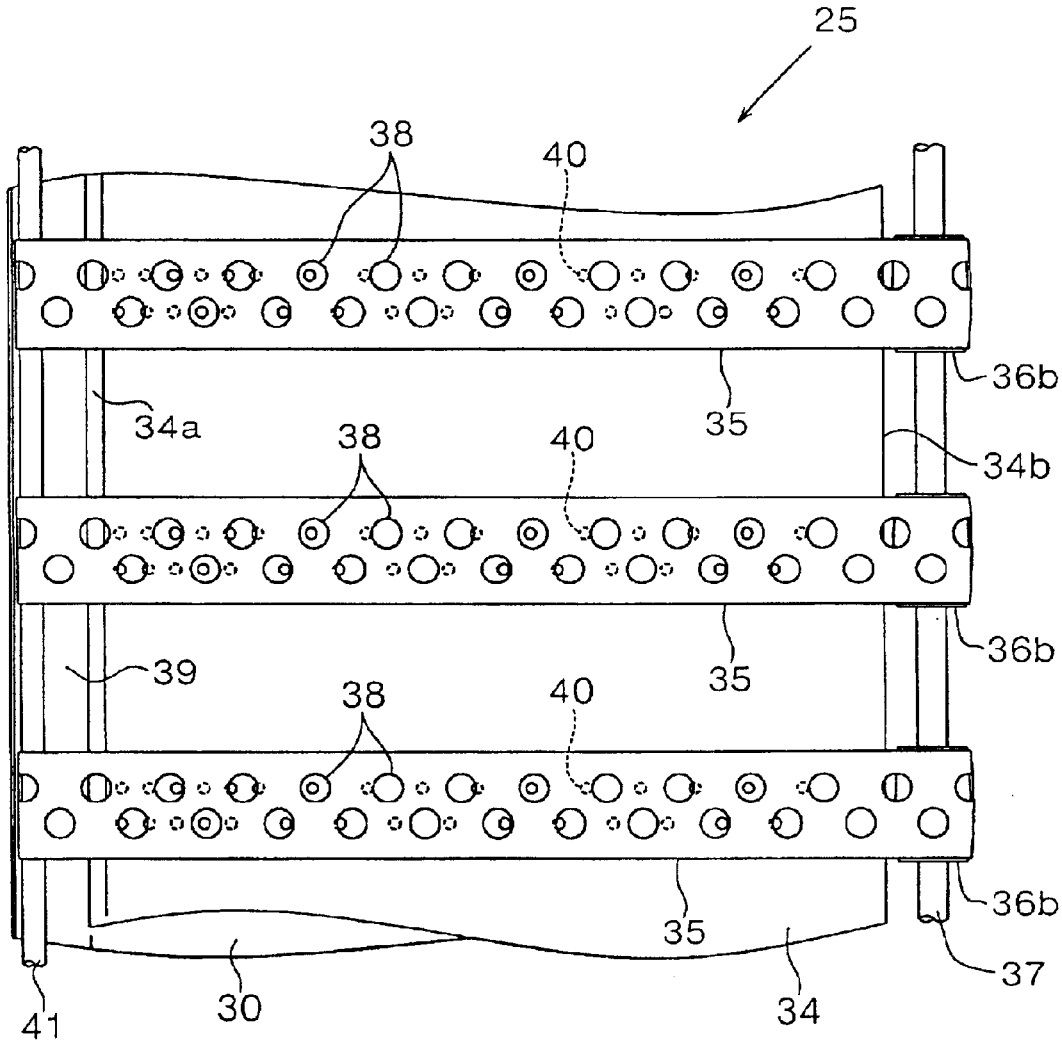
FIG. 5 is a plan view showing a fourth example of suction transfer means.

FIG. 5 is a plan view showing a fourth example of the suction transfer means.

According to the suction transfer means 25 shown in FIG. 5, in the suction transfer means 25 of the third example shown by FIGS. 4(*a*) and 4(*b*), the transfer suction ports 40 are made smaller and are formed such that a total opening area of the transfer suction ports 40 is made smaller than a total opening area of the exfoliation suction port 39.

Specifically, the transfer suction ports 40 are formed such that the total opening area of the transfer suction ports 40 as compared with the total opening area of the exfoliation suction port 39 is made to constitute substantially 10:1.

Further, the transfer suction ports 40 are formed such that arrangement thereof on the side of the one end portion 34*a* of the guide plate 34 constituting the side of the printing section 3 becomes dense as compared with that of the side of the other end portion 34*b*.

Thereby, according to the fourth example of the suction transfer means 25, the suction force of the exfoliation suction port 39 is increased by the relationship of the respective total opening areas to thereby further increase the suction force for exfoliating the printed print sheet P from the side of the outer peripheral face of the printing drum 16 (peripheral wall 15).

Further, according to the fourth example of the suction transfer means 25, by making arrangement of the transfer suction ports 40 dense on the side of the one end portion 34*a* of the guide plate 34, the print sheet P is attracted to the transfer belt 35 on the side of the one end portion 34*a* of the guide plate 34 to thereby help exfoliate the print sheet P from the printing drum 16.

The above-described first through fourth examples of the suction transfer means 25, are arranged to the stencil printing machine as shown by FIG. 6 through FIG. 10. Further, the suction transfer means 25 shown by FIG. 6 through FIG. 10, constitute the suction transfer means 25 of the fourth example.

Figure 6:
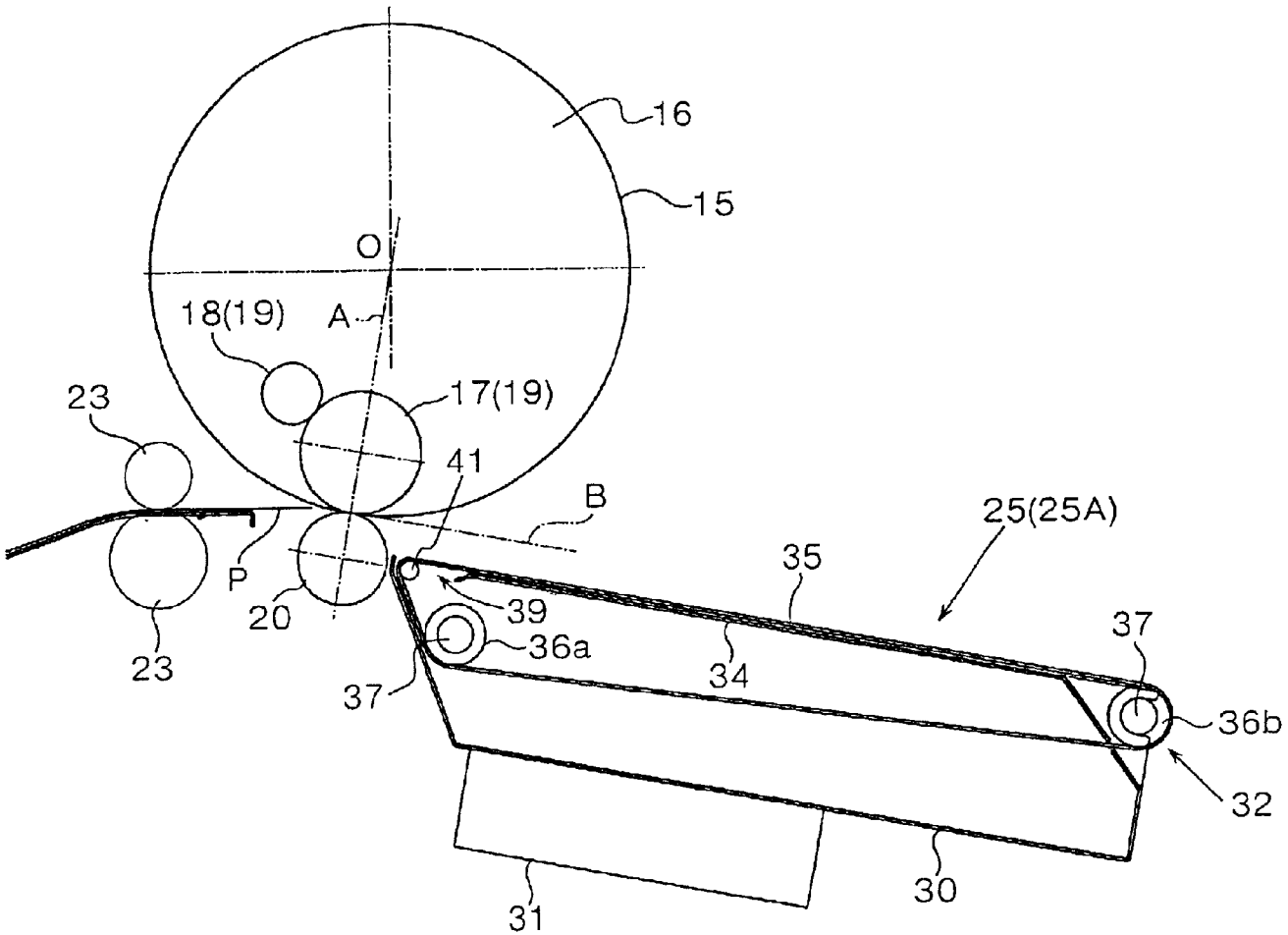
FIG. 6 is a side view showing arrangement of suction transfer means relative to the stencil printing machine.
Figure 9:
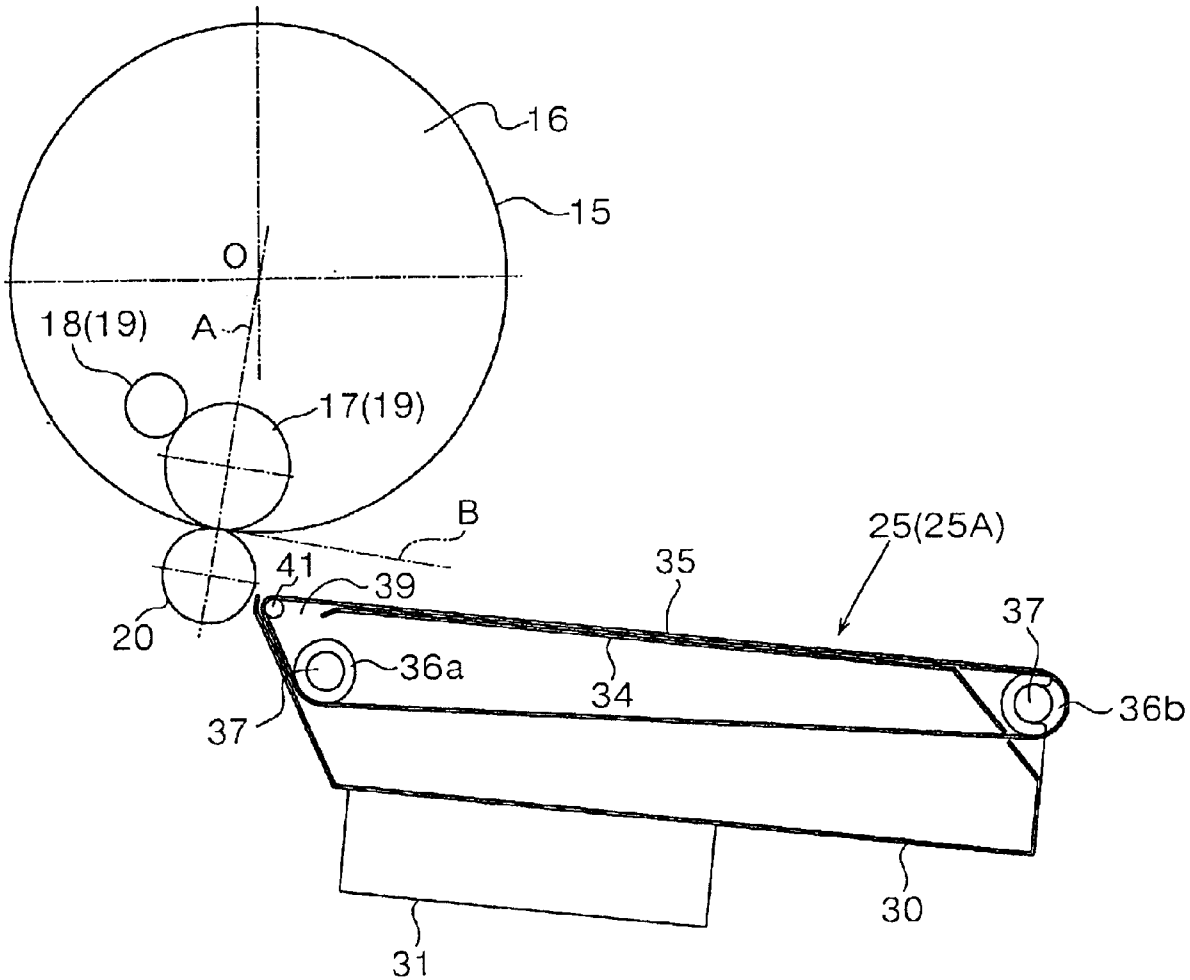
FIG. 9 is a side view showing arrangement of suction transfer means relative to the stencil printing machine.
Figure 10:
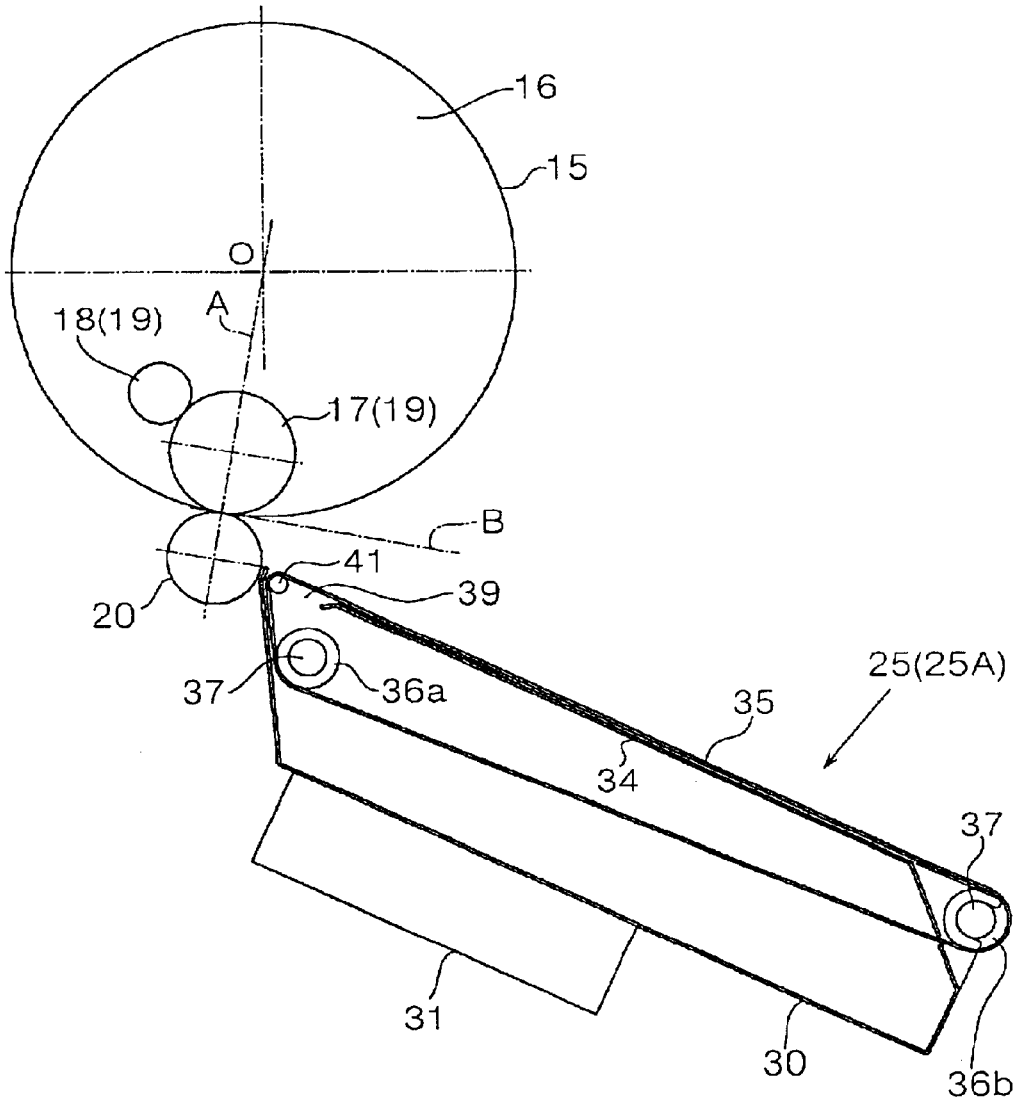
FIG. 10 is a side view showing arrangement of suction transfer means relative to the stencil printing machine.

According to the suction transfer means 25, As shown by FIG. 6, FIG. 9 and FIG. 10, the exfoliation suction port 39 is arranged to dispose on a lower side of a reference line B. The reference line B is orthogonal to a center line A of the squeegee roller 17 intersecting with the axis line O of the printing drum 16. Further, The reference line B passes through a position at which the press roller 20 and the side of the printing drum 16 are brought into press contact with each other. The exfoliation suction port 39 is arranged to be proximate to the press roller 20.

Thereby, the exfoliation suction port 39 becomes proximate to a position immediately after the print sheet P is brought into press contact with the side of the printing drum 16 by the press roller 20 to thereby operate the suction force for exfoliating the print sheet P from the side of the printing drum 16 immediately after printing.

Figure 7:
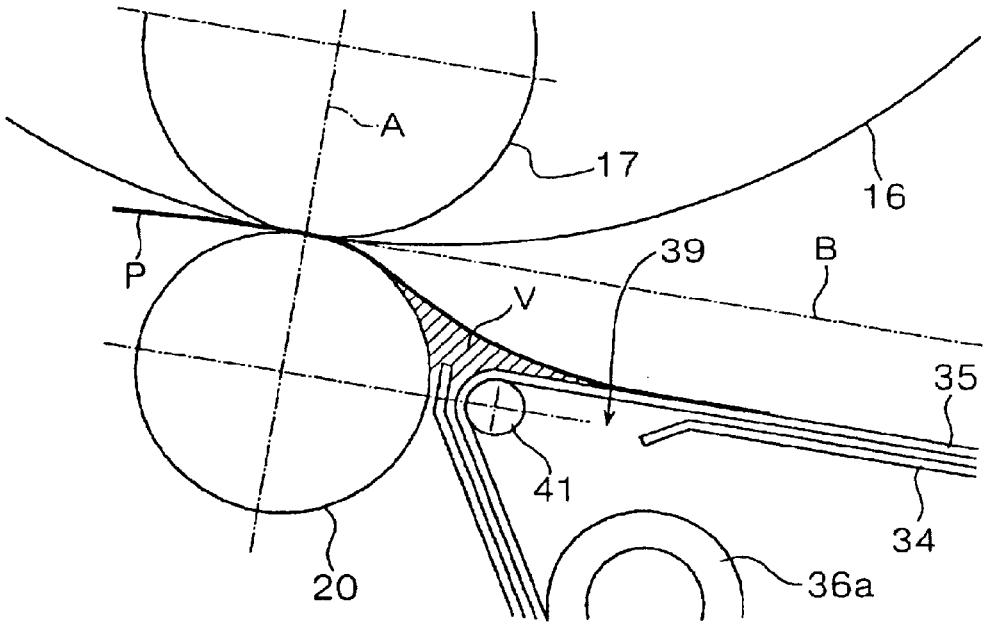
FIG. 7 is a partially enlarged view of FIG. 6.

When arranged in this way, for example, as shown by FIG. 7 constituting a partially enlarged view of FIG. 6, in a state in which the print sheet P which has passed through the press contact position of the press roller 20 and the side of the printing drum 16, is sucked to the side of the transfer belt 35 by the suction force of the exfoliation suction port 39, there is formed a suction area V surrounded by the pres roller 20, the print sheet P and the transfer belt 35.

Further, the print sheet P which has successively passed the press contact position, is successively sucked and transferred to the side of the transfer belt 35 by the suction area V.

Figure 8:
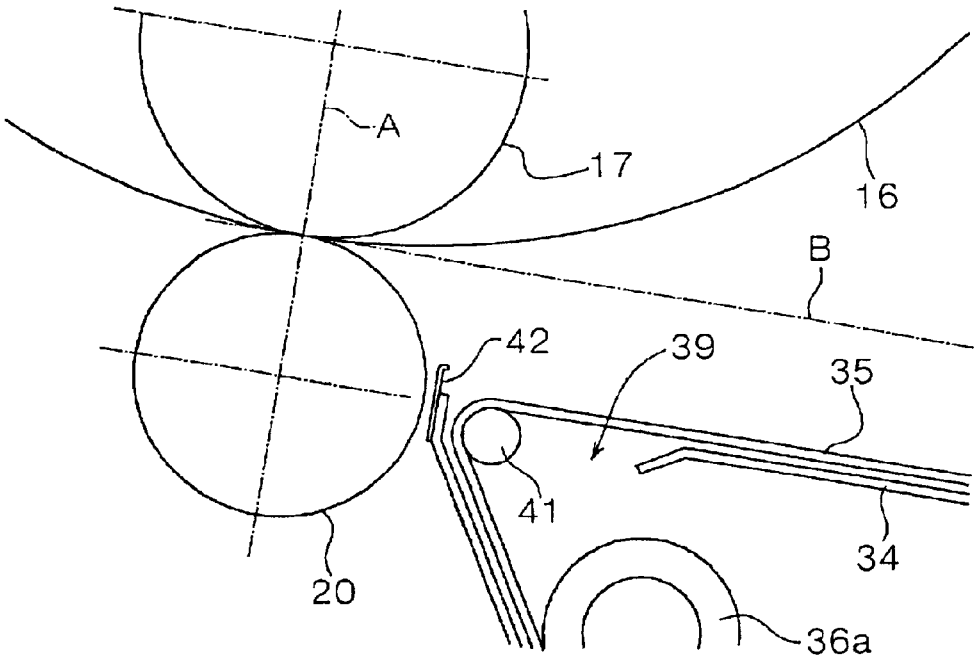
FIG. 8 is a side view showing arrangement of suction transfer means relative to the stencil printing machine.

Further, as shown by FIG. 8, there may be provided an extension piece 42 extended to an upper side relative to the front face of the case 30 provided with the exfoliation suction port 39 and directed to the side of the printing section 3. Thereby, the suction force by the exfoliation suction port 39 is more efficiently operated to the print sheet P.

Further, although according to the suction transfer means 25 shown in the respective drawings, the guide plate 34 is formed in a shape of a flat plate, the guide plate 34 may be formed to bend such that the other end portion 34*b* is disposed on a side lower than one end portion 34*a*.

Further, according to arrangement of the suction transfer means 25 shown in FIG. 6, the suction transfer means 25 is arranged such that the upper face of the guide plate 34 along which the transfer belt 35 is disposed, becomes in parallel with the reference line B.

In contrast thereto, as shown by FIG. 9, the suction transfer means 25 may be arranged such that the upper face of the guide plate 34 along which the transfer belt 35 is disposed, intersects with the reference line B.

In this case, the print sheet P exfoliated from the side of the printing drum 16 by the suction force of the exfoliation suction port 39, becomes more proximate to adsorb to the side of the transfer belt 35.

Further, as shown by FIG. 10, the suction transfer means 25 may be arranged such that the upper face of the guide plate 34 along which the transfer belt 35 is disposed, becomes remote from the reference line B.

In this case, similar to the constitution in which the other end portion 34*b* of the guide plate 34 is disposed on the lower side of the one end portion 34*a*, in a procedure of transferring the print sheet P, transfer force is operated in a direction of exfoliating the print sheet P from the side of the printing drum 16.

Further, in FIG. 6 through FIG. 10 showing the arrangements of the suction transfer means 25, there is constructed a constitution in which when the press roller 20 is disposed at the press contact position at which the print sheet P is brought into press contact with the side of the printing drum 16, a center of the press roller 20 is disposed on the center line A of the squeeze roller 17.

Otherwise, there is also constructed a constitution in which when the press roller 20 is disposed at the press contact position, the press roller 20 is made to dispose at a position shifted from the center line A of the squeeze roller 17 to the sheet supply side to thereby improve pinching of the print sheet P. Even in this case, the suction transfer means 25 may be arranged as mentioned above.

Therefore, according to the above-described stencil printing machine, by the suction transfer means 25, there can be carried out both of exfoliation of the print sheet P from the side of the printing drum 16 and transfer of the print sheet P to the sheet discharge base 24 which have been carried out by separate constitutions conventionally.

Further, with regard to exfoliation of the print sheet P from the side of the printing drum 16, in place of the conventional constitution of the separating claw or the air blow fan, there is constructed a system of sucking the print sheet P and accordingly, the printed image face of the print sheet is not touched and the print quality of the image portion can be prevented from being deteriorated.

Further, according to the suction transfer means 25, the exfoliation suction port 39 is arranged on the side of the printing drum 16 of the case 30. Thereby, the exfoliation suction port 39 can further be made proximate to the position at which the press roller 20 is brought into press contact with the side of the printing drum 16 and suction operation by the exfoliation suction port 39 can sufficiently be achieved.

Further, according to the suction transfer means 25, the suction force of the exfoliation suction port 39 can be increased by arranging the suction force generating portion 31 and setting the total opening area of the transfer suction port 40 relative to that of the exfoliation suction port 39. Therefore, the suction force for exfoliating the printed print sheet P from the side of the outer peripheral face of printing drum 16 (peripheral wall 15) can increased.

Thereby, the print sheet P can stably and efficiently be exfoliated from the side of the printing drum 16. Further, even when the printing rate of the printed image is large or deviated, there can be resolved drawbacks such as blot of the printed image, occurrence of gradation, setoff and sheet discharge jam and so on.

Further, the print sheet P is stably and efficiently exfoliated from the side of the printing drum 16 by the suction transfer means 25. Thereby, even when the printing rate of the printed image is large or deviated, a change in a timing of separating the print sheet P from the side of the printing drum 16 can be dispensed with and the print sheet P can be separated from the side of the printing drum 16 to align the position of the front end of the sheet.

Thereby, particularly, as mentioned later, according to a stencil printing machine for carrying out multiple block printing or double-faced printing by providing other printing drum at a post stage of the printing drum 16, there can be prevented a shift of a printed image printed at the printing drum at the post stage relative to an image of the print sheet P printed by the printing drum 16 at an initial stage.

Figure 11:
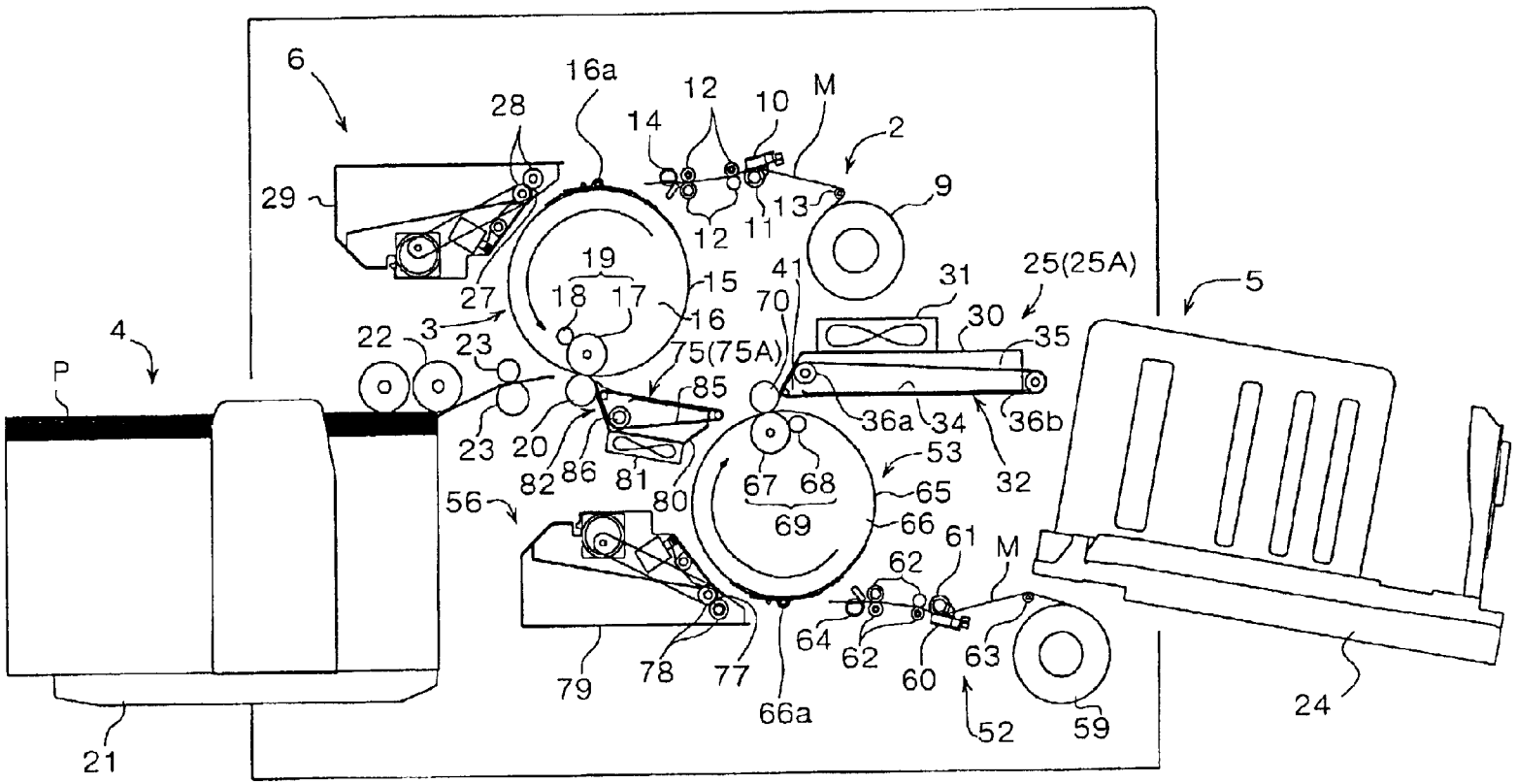
FIG. 11 is a side view showing an example of a stencil printing machine having a plurality of printing drums.

An explanation will be given of a stencil printing machine having a plurality of printing drums, mentioned above, as follows. FIG. 11 is a side view showing an example of a stencil printing machine having a plurality of printing drums.

Further, according to the example of the stencil printing machine, explained below, with respect to the stencil printing machine exemplified in FIG. 1, mentioned above, there are provided a printing section 53 for carrying out further printing, and a stencil making section 52 and a stencil sheet discharge section 56 related to the printing section 53. The stencil making section 52 and the printing section 53 are provided between the printing section 3 and the sheet discharge section 5.

Therefore, portions the same as or equivalent to those of the stencil printing machine shown in FIG. 1, mentioned above, are attached with the same notations and an explanation thereof will be omitted. Further, the constitution related to the original document reading section 1 is omitted.

As shown by FIG. 11, the stencil making section 52 is arranged upside down relative to the stencil making section 2. The stencil making section 52 is provided with a stencil sheet roll section 59, a thermal head 60 constituted by a plurality of pieces of dot-like heat generating bodies arranged transversely in one row, a platen roller 61 and stencil sheet feed rollers 62, a stencil sheet guide roller 63 and a stencil sheet cutter 64.

Further, by rotation of the platen roller 61, stencil sheet M is continuously drawn from the stencil sheet roll section 59 and is transferred between the thermal head 60 and the platen roller 61. The thermal head 60 is inputted with image data of original document read by the original document reading section 1, mentioned above.

Further, by generating heat by the plurality of pieces of dot-like heat generating bodies of the thermal head 60 respectively individually and selectively, thermosensitive perforation is carried out to the thermosensitive stencil sheet M in a dot matrix style.

In the perforating operation, the stencil sheet M drawn from the stencil sheet roll section 59 by the platen roller 61, is exerted with desired tensile force by the stencil sheet guide roller 63 to thereby prevent occurrence of wrinkle or the like.

Further, the perforated stencil sheet M is transferred further by the stencil sheet feed rollers 62 and is cut by one printing block by the stencil sheet cutter 64.

As shown by FIG. 11, the printing section 53 is arranged upside down relative to the printing section 3. The printing section 53 is provided with a printing drum 66 arranged with an ink-permeable peripheral wall 65 in a cylindrical shape. The peripheral wall 65 has a porous structure and is constituted by a porous metal plate, a mesh structure body or the like.

The printing drum 66 is driven to rotate in the clockwise direction of FIG. 11 around an axis line of its own by driving means, not illustrated. Further, at an outer periphery of the printing drum 66, there is provided a clamp section 66*a* for clamping a front end portion of the stencil sheet M.

Further, by rotating the printing drum 66 while clamping a front end portion of the transferred and perforated stencil sheet M by the clamp section 66*a*, the stencil sheet M is attached to be wound around an outer peripheral face thereof.

Further, at an inner portion of the printing drum 66, there is provided an ink supply apparatus 69 comprising an ink supply roller 67 and a doctor roller 68. Further, on an outer side of the printing drum 66, a press roller 70 is provided movably to be attachable to and detachable from the outer peripheral face of the printing drum 66 (peripheral wall 65).

As shown by FIG. 11, the stencil sheet discharge section 56 is arranged upside down relative to the stencil sheet discharge section 6. The stencil sheet discharge section 56 is provided on one side (left side of FIG. 11) of the printing section 53.

The stencil sheet discharge section 56 is provided with a separating claw 77 for separating the stencil sheet M used from the printing drum 66, stencil sheet discharge rollers 78 for transferring the exfoliated stencil sheet M and a stencil sheet discharge box 79 for containing the transferred stencil sheet M.

At the sheet discharge section 5 shown in FIG. 11, there is adopted the suction transfer means 25 according to the third example or the fourth example, further, the suction transfer means 25 is arranged upside down relative to the constitution shown in FIG. 1.

That is, according to the suction transfer means 25 shown in FIG. 11, the case 30 is formed in a box-like shape having the guide plate 34 in a plate-like shape at a lower face thereof. Further, the suction force generating means 31 is provided at a plane of the case 30 for exhausting air in the case 30 to an upper side at outside of the case 30.

Further, the transfer belt 35 is arranged to dispose along the lower face of the guide plate 34. Thereby, according to the suction transfer means 25 shown in FIG. 11, the suction force by the suction force generating section 31, constitutes the suction force for exfoliating the printed print sheet P from a side of the outer peripheral face of the printing drum 66 (peripheral wall 65), further, the suction force by the suction force generating section 31, constitutes the suction force for adsorbing print sheet P to a lower side face of the transfer belt 35 disposed along a lower face of the guide plate 34 and the print sheet P is transferred in the direction of the sheet discharge base 24 by rotating the transfer belt 35.

Figure 12:
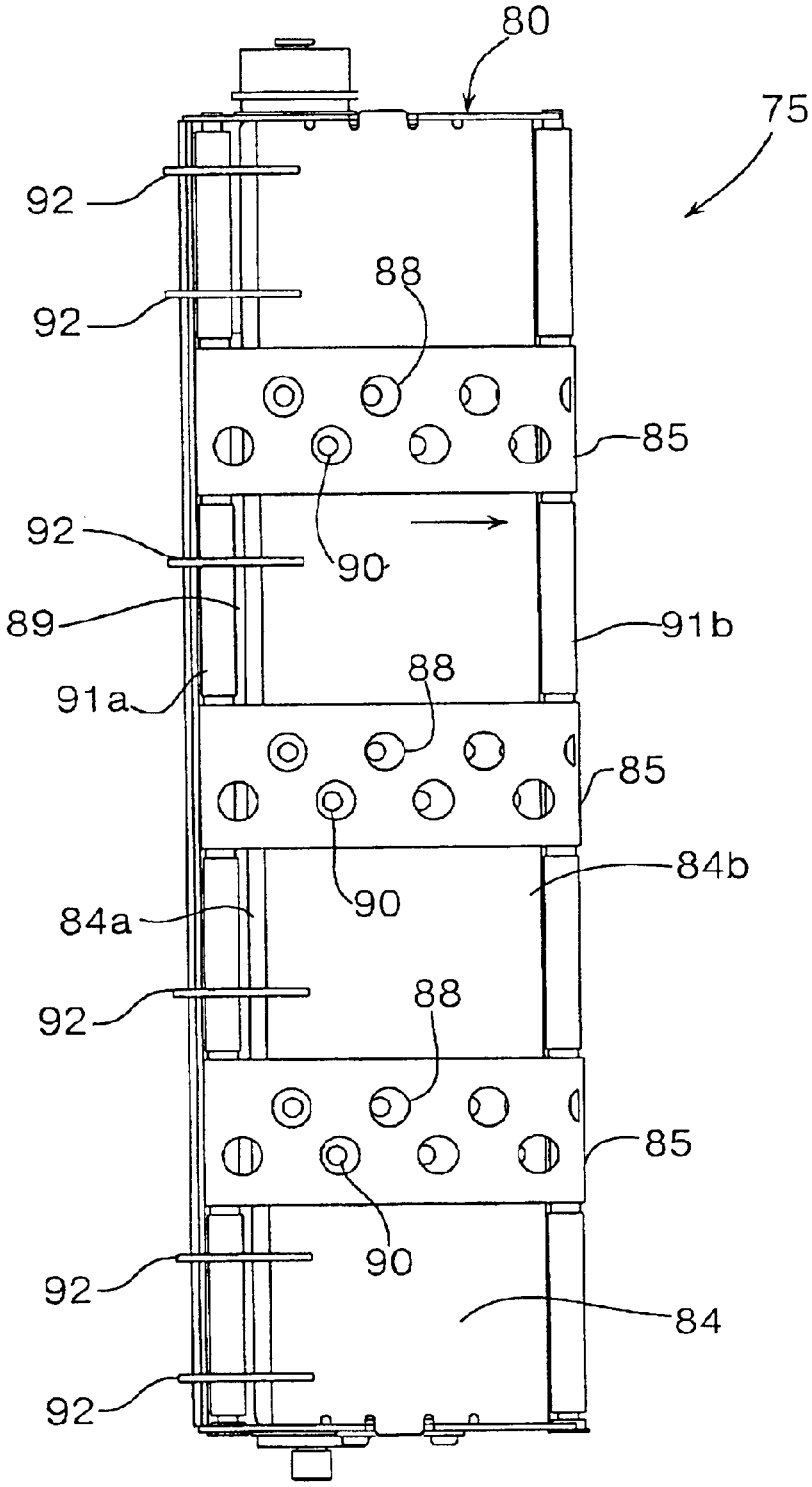
FIG. 12 is a plan view showing other suction transfer means.
Figure 13:
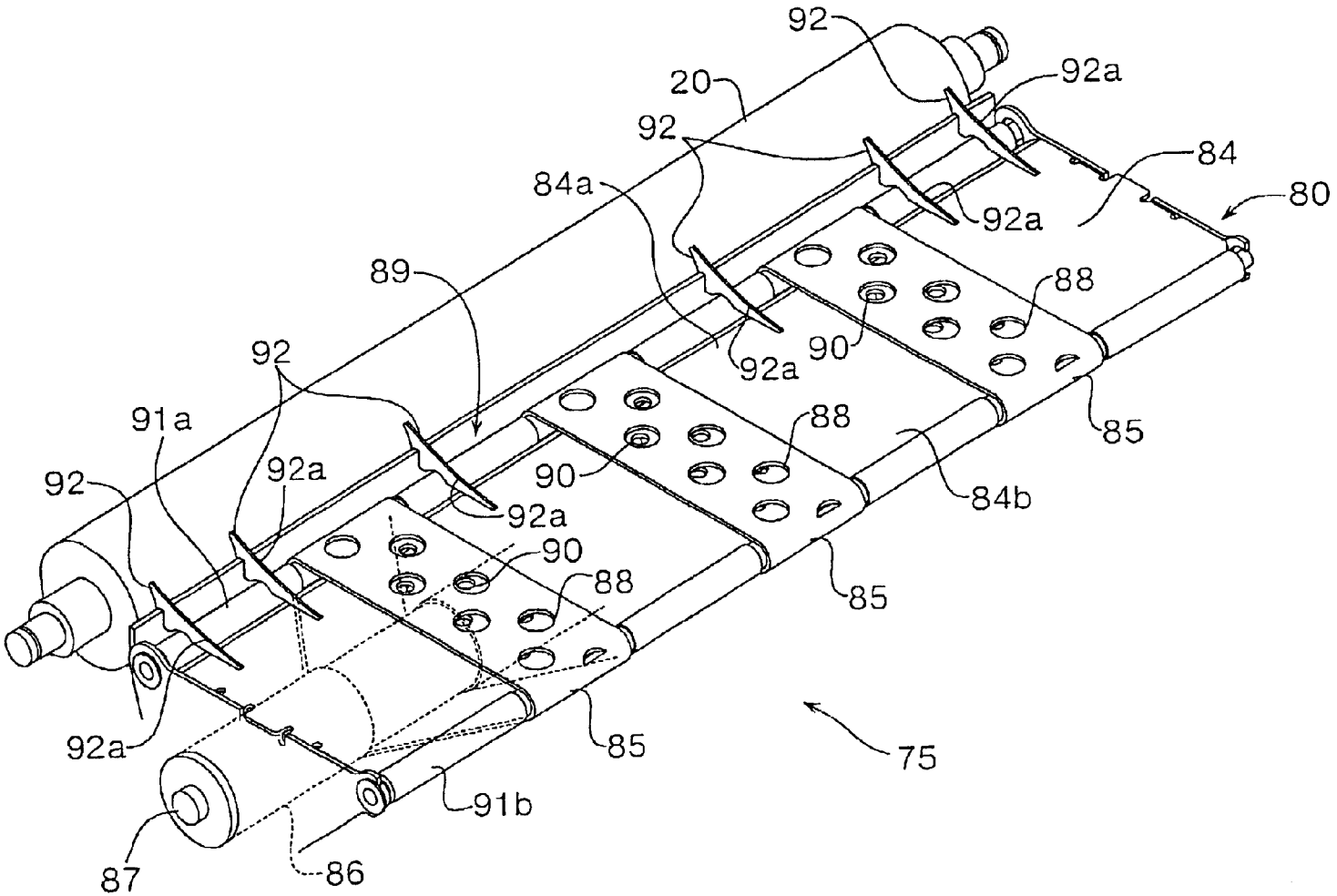
FIG. 13 is a perspective view showing the other suction transfer means.

Further, according to the stencil printing machine shown in FIG. 11, there is arranged other suction transfer means 75 between the printing drum 16 and the printing drum 66. As shown by FIG. 11 through FIG. 13, the suction transfer means 75 is provided with a case 80, a suction force generating section 81 and a transfer section 82.

The case 80 is formed in a box-like shape having a guide plate 84 in a plate-like shape at an upper face thereof. The guide plate 84 is formed substantially in a flat shape and is provided such that one end portion 84*a* thereof is directed to a side of the printing drum 16 and other end portion 84*b* thereof is directed to a side of the printing drum 66.

The suction force generating section 81 is provided at a bottom face of the case 80. The suction force generating section 81 is constituted by a suction fan according to the embodiment for exhausting air in the case 80 to a lower side at outside of the case 80.

An exfoliation suction port 89 is provided at the one end portion 84*a* of the guide plate 84 directed to the side of the printing drum 16. The exfoliation suction port 89 is provided with a gap between the one end portion 84*a* of the guide plate 84 and the case 80. The gap constitutes the exfoliation suction port 89. According to the suction port 89, suction force by the suction force generating section 81, constitutes suction force for exfoliating the printed print sheet P from the side of the outer peripheral face of the printing drum 16 (peripheral wall 15).

According to the transfer section 82, a portion of a transfer belt 85 constituting a strip member formed in an endless shape, is arranged to dispose along an upper face of the guide plate 84. The transfer belt 85 is hung along a transfer direction of the print sheet P by the following constitution.

As shown by FIG. 12 and FIG. 13, a support shaft 91*a* is provided at an opening portion of the exfoliation suction port 89. Further, a support shaft 91*b* similar to the shaft 91*a* is provided on a side of the other end portion 84*b* of the guide plate 84. Further, a pulley 86 fixed to a support shaft 87 is provided on a lower side of the support shaft 91*a* and at an inner portion of the case 80.

The support shafts 91*a* and 91*b* and the support shaft 87 are in parallel with each other and rotatably supported by the side of the case 80. The transfer belt 85 is hung around the support shafts 91*a* and 91*b* and the pulley 86 of the support shaft 84.

Thereby, the transfer belt 85 is supported by the support shafts 91*a* and 91*b* to dispose along the upper face of the guide plate 84, further, drawn from the exfoliation suction port 89 into the case 30, extended to an outer side of the case 80 via the pulley 86 and reaches the support shaft 91*b*.

Further, the transfer belt 85 is provided with a vent hole 88. As shown by FIG. 12, a plurality of the vent holes 88 are formed to open substantially in a circular shape at predetermined intervals.

Further, the support shaft 87 constitutes a drive shaft which is driven to rotate at predetermined speed by receiving rotational force from the drive motor, not illustrated. The support shafts 91*a* and 91*b* constitute driven shafts. Further, by driving to rotate the support shaft 87 constituting the drive shaft, the transfer belt 85 is rotated to circulate in an arrow mark direction of FIG. 12.

At a portion of the guide plate 84 overlapping the transfer belt 85, there are provided transfer suction ports 90. A plurality of the transfer suction ports 90 are formed to open substantially in a circular shape at equal intervals.

The transfer suction ports 90 overlap the vent hole 88 provided at the transfer belt 85 and at the overlapped portion, suction force by the suction force generating portion 81, constitutes suction force for adsorbing the print sheet P to a side of the transfer belt 85.

That is, the print sheet P adsorbed to the transfer belt 85 is transferred in the direction of the printing drum 66 constituting the arrow mark direction of FIG. 12 by rotating the transfer belt 85.

Further, as shown by FIG. 11, a front face of the case 80 provided with the exfoliation suction port 89 (support shaft 91*a*) and directed to the side of the printing drum 16, is formed inclinedly to the transfer direction of the print sheet P to direct in a lower direction.

Thereby, similar to the suction transfer means 25 shown by FIG. 6, FIG. 9 and FIG. 10, according to the suction transfer means 75, the side of the exfoliation suction port 89 is made to be further proximate to a press contact portion of the printing drum 16 and the press roller 20 to thereby sufficiently achieve suction operation by the exfoliation suction port 89.

Further, the transfer belt 85 is extended to the opening portion of the exfoliation suction port 89 and therefore, the printed print sheet P exfoliated from the side of the outer peripheral face of the printing drum 16 (peripheral wall 15) can immediately be transferred by the transfer belt 85.

Further, a rear face of the case 80 provided with the support shaft 91*b* and directed to the side of the printing drum 66, is formed inclinedly reverse to the transfer direction of the print sheet P to direct in a lower direction.

Thereby, according to the suction transfer means 75, a portion of the transfer belt 85 supported by the support shaft 91*b* is made to be proximate to a press contact portion of the printing drum 66 and the press roller 70 to thereby promote accuracy of delivering the print sheet P to the side of the printing drum 66.

Further, in order to arrange the suction transfer means 75 between the printing drum 16 and the printing drum 66, the suction transfer means 75 is formed to be shorter in the transfer direction than that of the suction transfer means 25 to thereby achieve small-sized formation.

As described above, according to the stencil printing machine shown in FIG. 11, the print sheet P after having been printed by the side of the printing drum 16 is transferred to the side of the printing drum 66 via the suction transfer means 75.

At the printing drum 66, a predetermined amount of ink is supplied to an inner peripheral face of the peripheral wall 65 by the ink supply apparatus 69. The printing drum 66 is driven to rotate in the clockwise direction of FIG. 11 around the axis line of its own.

Along therewith, the print sheet P transferred by the suction transfer means 75 is supplied between the printing drum 66 and the press roller 70. Further, by bringing the print sheet P into press contact with the stencil sheet M wound around the outer peripheral face of the printing drum 66 (peripheral wall 65) by moving the press roller 70, ink which has passed through the stencil sheet M, is transcribed from the printing drum 66 onto the print sheet P to thereby carry out stencil printing.

Meanwhile, according to the above-described suction transfer means 75, exfoliation of the print sheet P from the side of the printing drum 16 is carried out stably and efficiently by sufficiently achieving suction operation by the exfoliation suction port 89.

Figure 14:
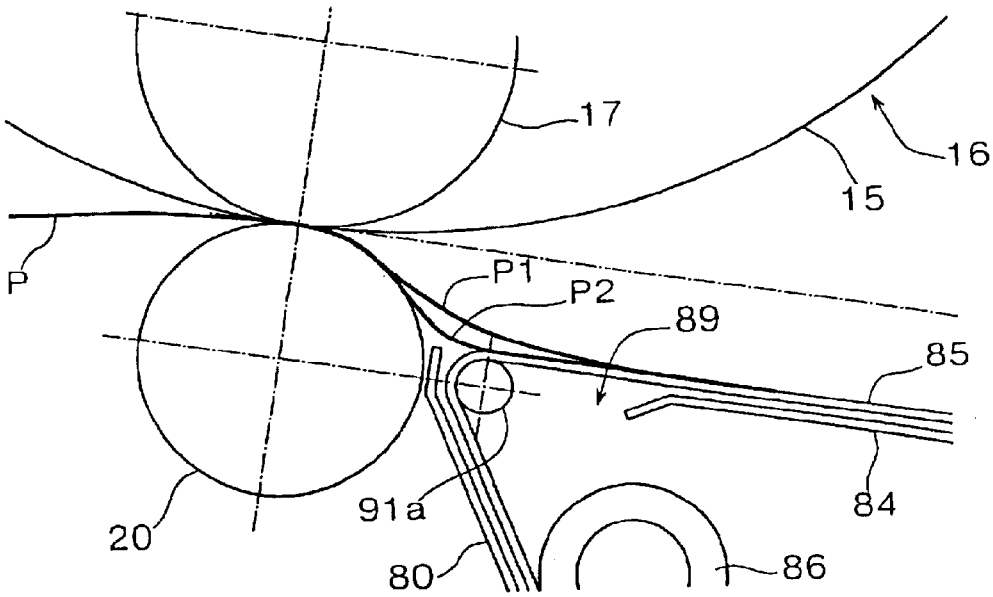
FIG. 14 is a view showing track of print sheet when printing speed or paper quality differs.

When print speed (sheet feed speed) or sheet quality of the print sheet P is changed, there is caused a change in a track after exfoliation of the print sheet P sucked by the exfoliation suction port 89 as shown by notation P1 or P2 of FIG. 14.

Specifically, in the case of fast print speed or the print sheet P having a paper quality which is provided with a rigidity, a track of P1 is constituted and in the case of low print speed or the print sheet P having a paper quality which is not provided with a rigidity, a track of P2 is constituted.

When the print sheet P travels different tracks as indicated by notations P1 and P2, there is caused a shift in a position of a sheet front end of the print sheet P in the transfer direction although the shift is small. According to the invention, the shift in the position of the sheet front end is eliminated by the following constitution.

Figure 15:
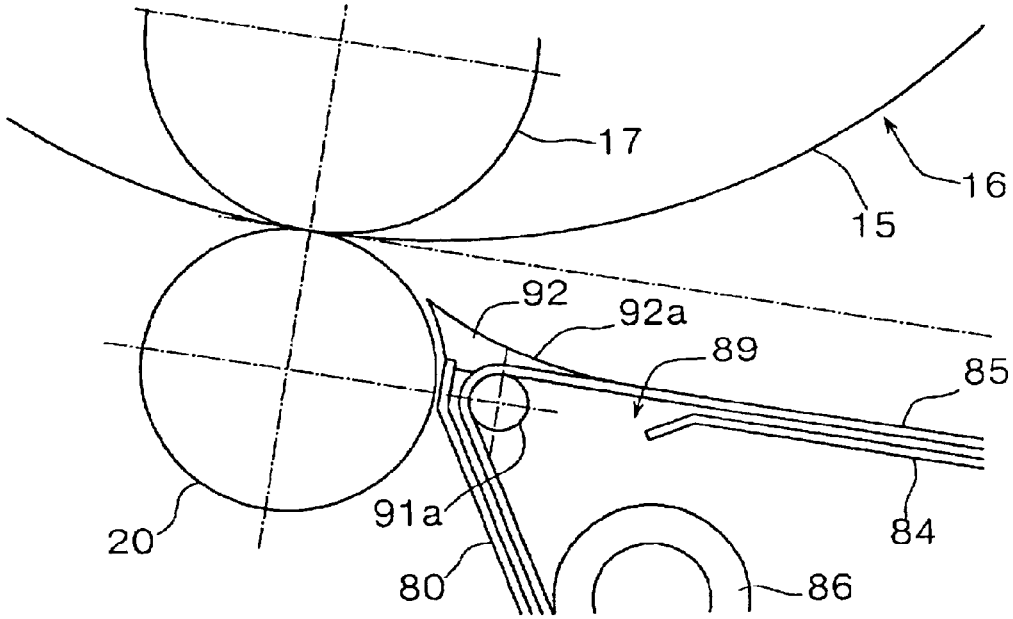
FIG. 15 is a side view showing suction transfer means provided with a guide rib.

As shown by FIG. 15, at a portion of the exfoliation suction port 89, there is provided a guide rib 92. According to the guide rib 92, an upper end edge 92*a* thereof is brought into contact with a nonprinted face side of the print sheet P exfoliated from the printing drum 16 at the exfoliation suction port 89 and supports the print sheet P without bending the print sheet P.

As shown by FIG. 15, the upper end edge 92*a* of the guide rib 92 is formed to constitute a track under a condition by which the supported print sheet P is not almost bent and guide the print sheet P exfoliated from the printing drum 16 smoothly onto the transfer belt 85.

That is, the upper end edge 92*a* is formed to constitute a track corresponding to P1. Further, the upper end edge 92*a* may constitute a linear track by which the print sheet P is not bent. As shown by FIG. 12 and FIG. 13, there are provided a plurality of the guide ribs 92 to constitute a plate piece shape without closing the exfoliation suction port 89.

In this way, by providing the guide ribs 92, even when the print speed or the sheet quality of the print sheet P is changed, there is not caused the change in the track after exfoliation of the print sheet P sucked by the exfoliation suction port 89 and therefore, there is not caused the shift in the position of the sheet front end of the print sheet P.

Thereby, exfoliation of the print sheet P from the side of the printing drum 16 can further be stabilized. Further, in the case of a stencil printing machine for carrying out multiple block printing or doubled-faced printing by providing the other printing drum 66 at a post stage of the printing drum 16 as shown by FIG. 11, a shift of a printed image printed by the printing drum 66 at the post stage relative to an image of the print sheet P printed by the printing drum 16 at an initial stage, can be eliminated and a print position can be positioned further accurately.

Further, the above-described guide rib 92 is not limited to adopt only at the suction transfer means 75 provided between a plurality of the printing drums 16 and 66 but may be adopted in the suction transfer means 25 for transferring the print sheet P from the printing drum 16 (66) to the sheet discharge section 5, mentioned above.

When the guide ribs 92 are adopted in the suction transfer means 25, by aligning the position of the sheet front end of the print sheet P, a state of feeding the print sheet P fed to the sheet discharge base 24 is not changed and therefore, sheet alignment of the sheet discharge base 24 can further be improved.

Further, although in the above-described all the examples, an explanation has been given of the suction transfer means 25 (75) comprising the case 30 (80), the suction force generating portion 31 (81), the exfoliation suction port 39 (89), the transfer section 32 (82) and the transfer suction port 40 (90), there may be constituted exfoliation suction means 25A (75A) excluding the vent holes 38 (88) provided at the transfer belt 35 (85) of the transfer section 32 (82) and the transfer suction port 40 (90).

Figure 16:
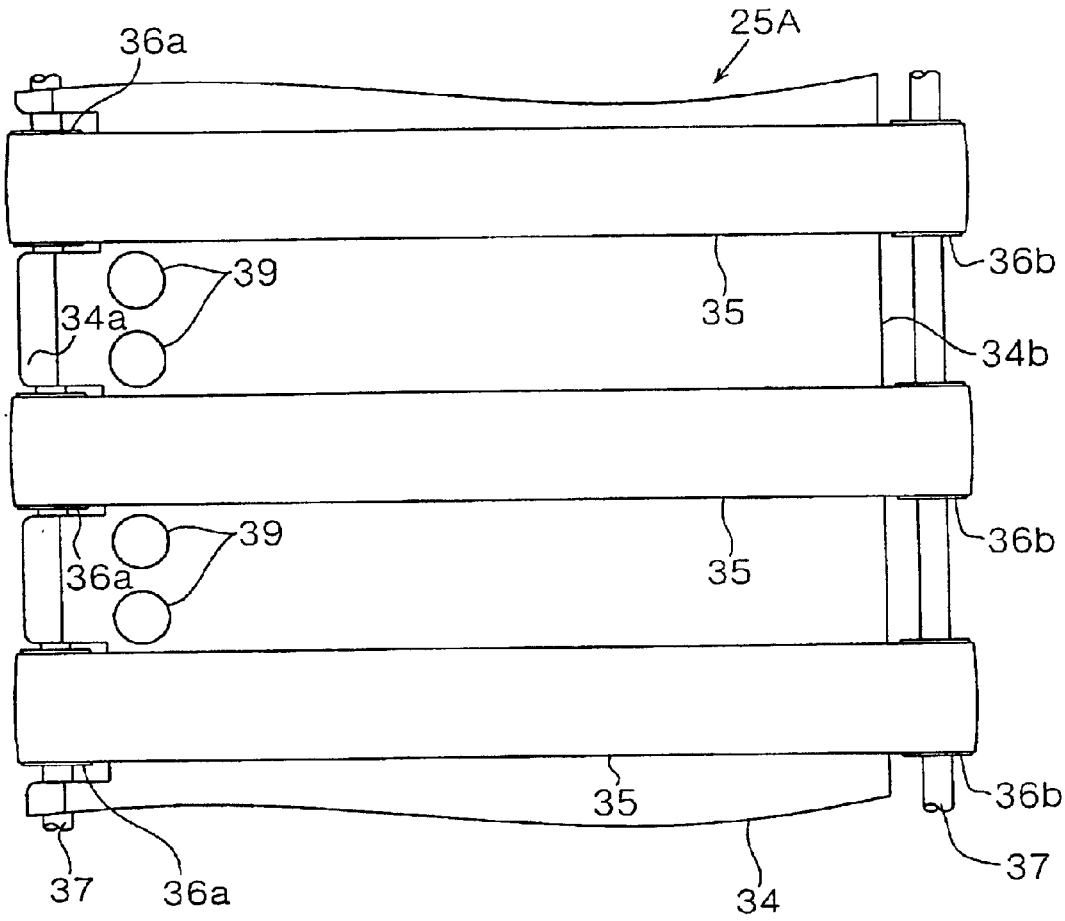
FIG. 16(*a*) is a plan view showing a first example of exfoliation suction means.
Figure 16:
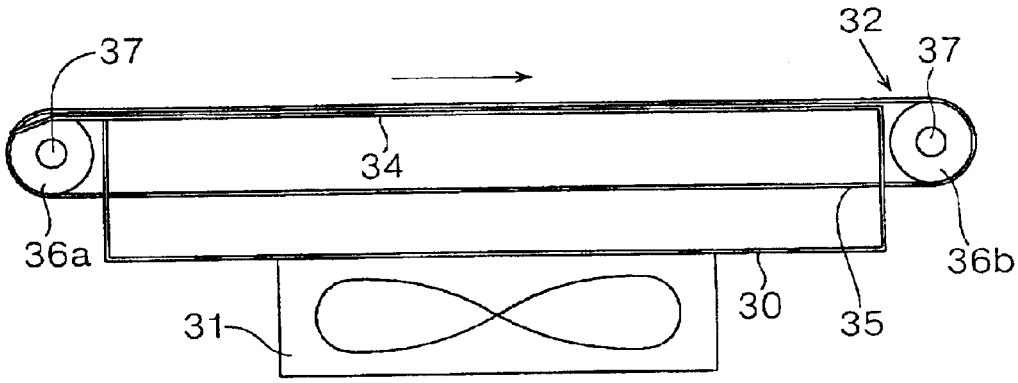
Figure 17:
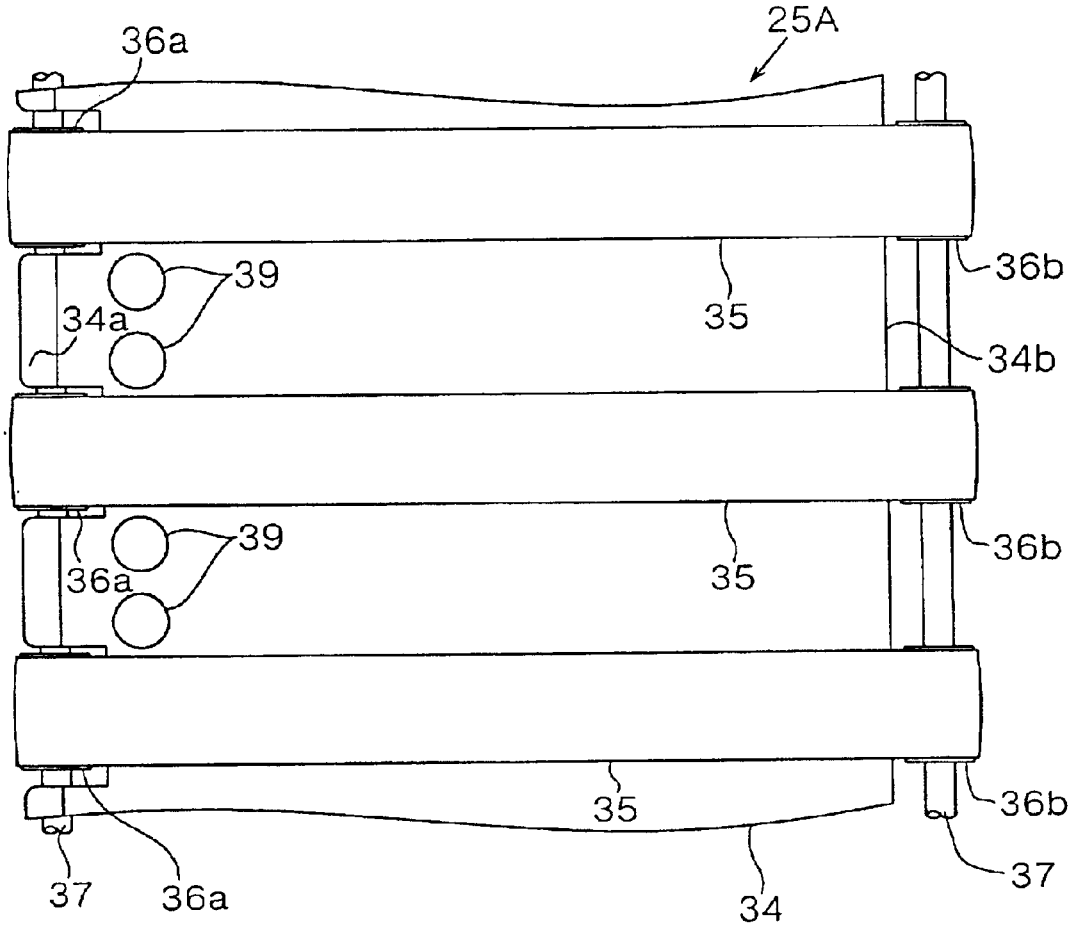
FIG. 17(*a*) is a plan view showing a second example of exfoliation suction means.
Figure 17:
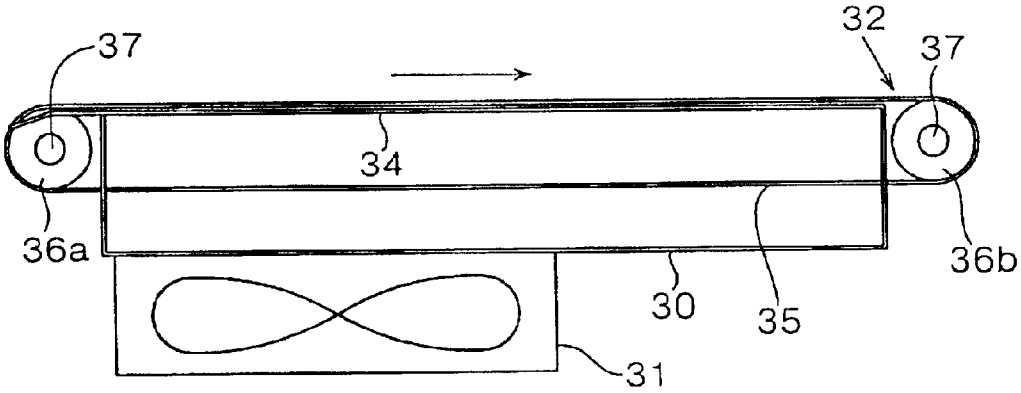
Figure 18:
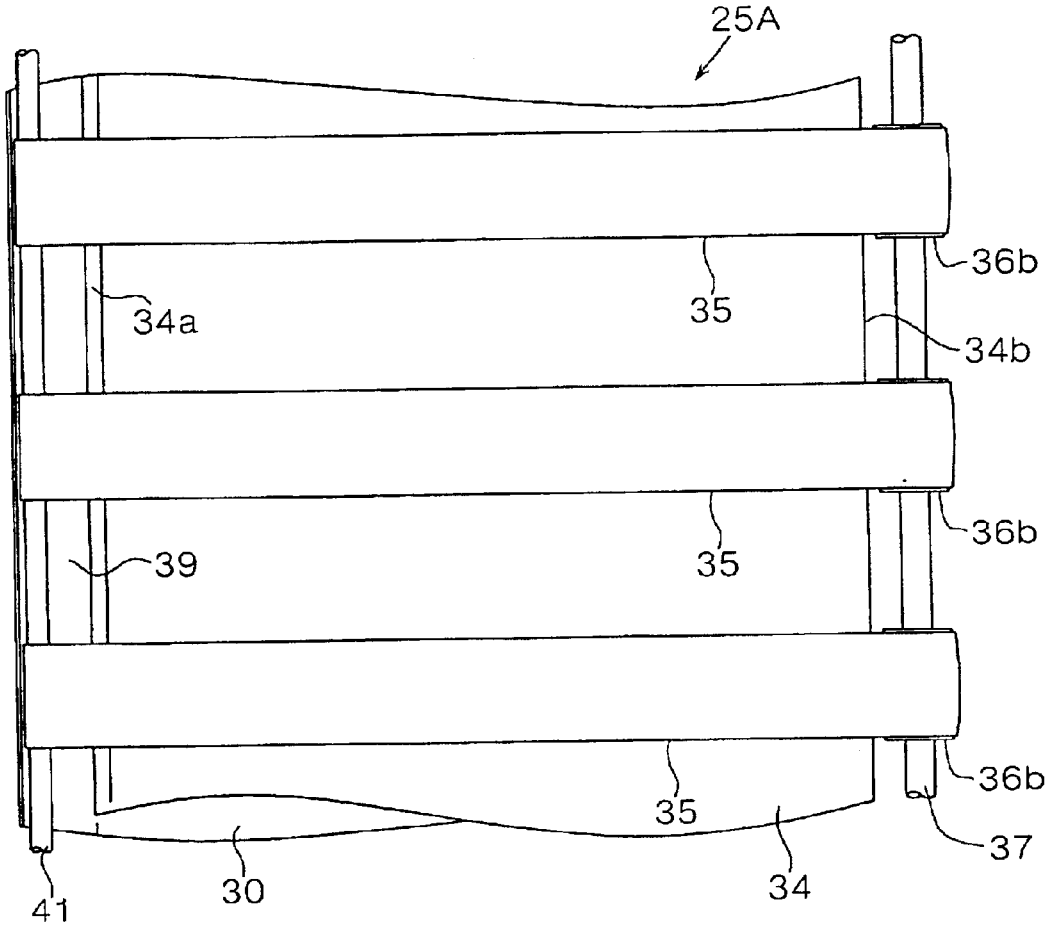
FIG. 18(*a*) is a plan view showing a third example of exfoliation suction means.
Figure 18:
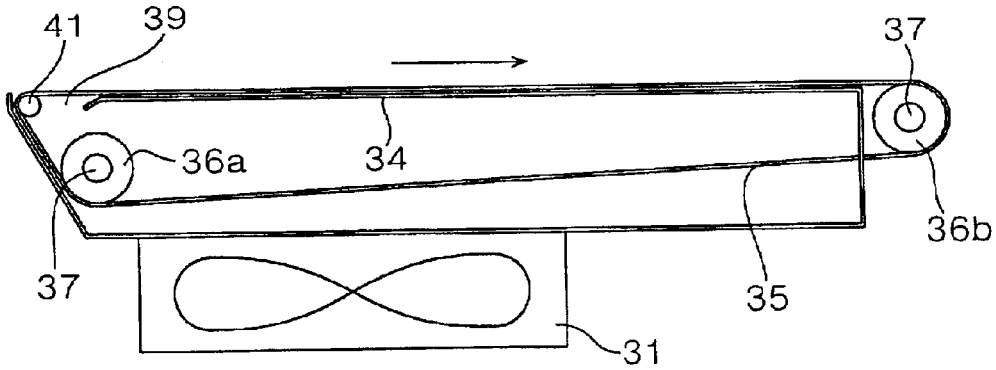
Figure 19:
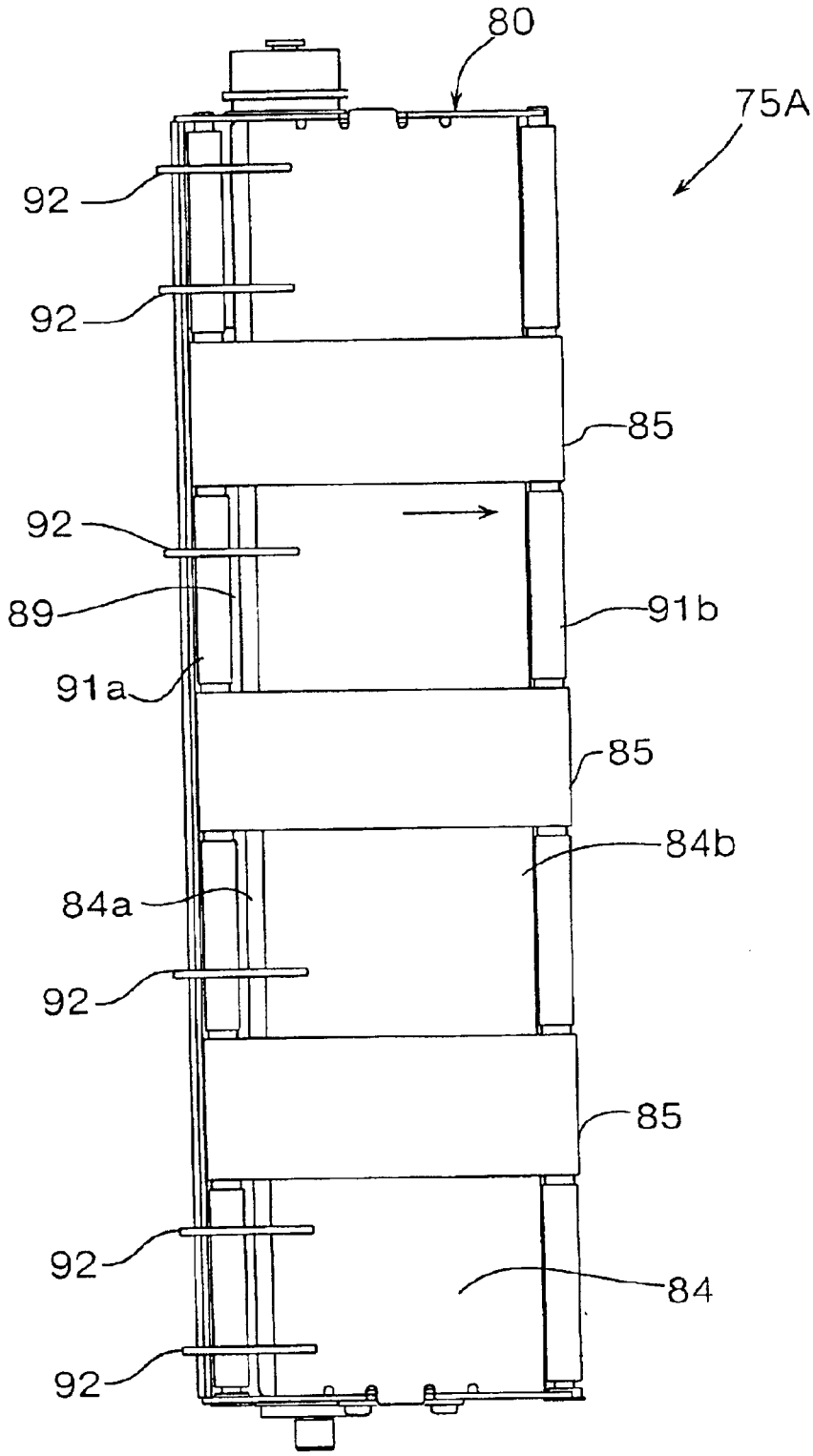
FIG. 19 is a plan view showing another exfoliation suction means.
Figure 20:
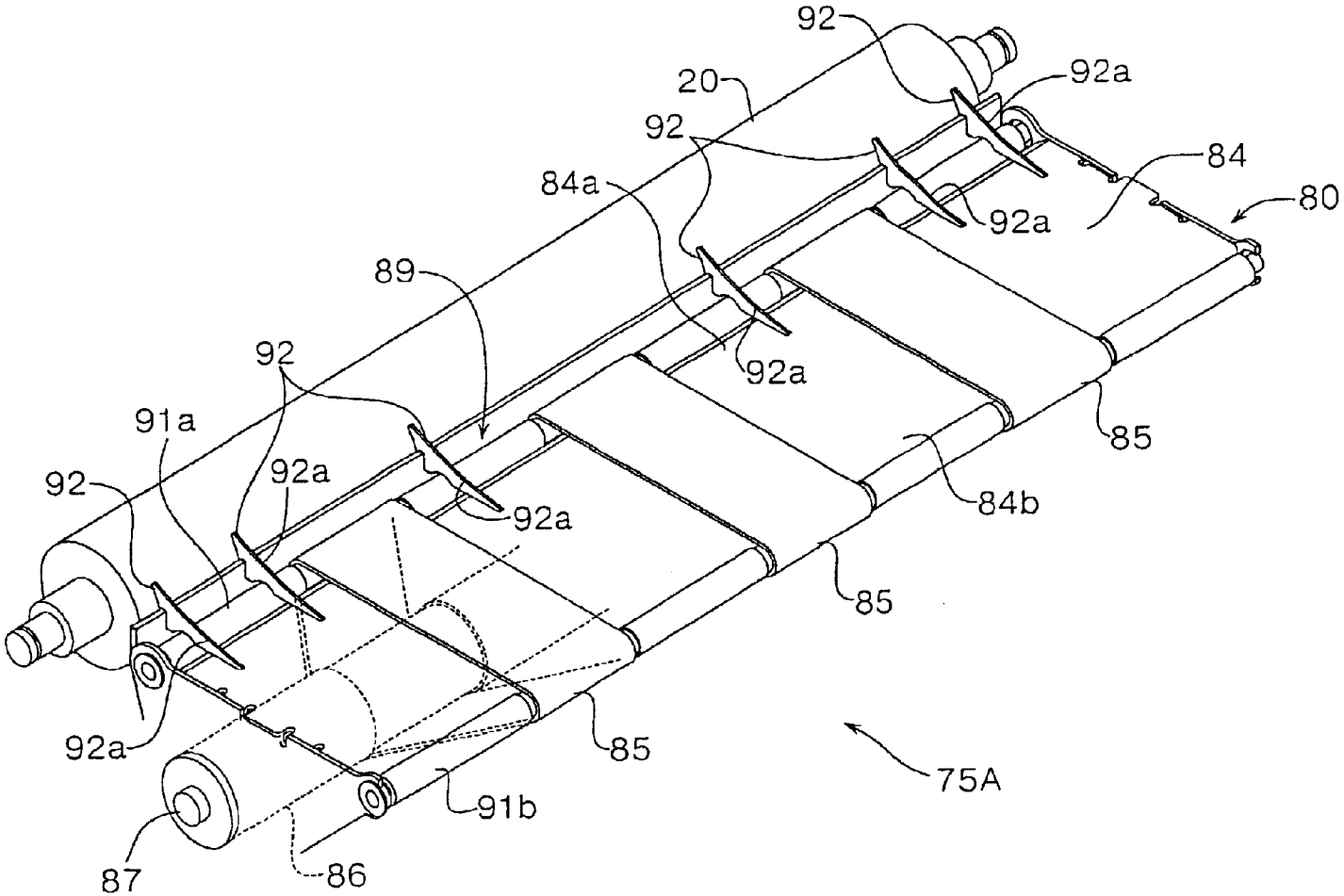
FIG. 20 is a perspective showing the another exfoliation suction means.
Figure 21:
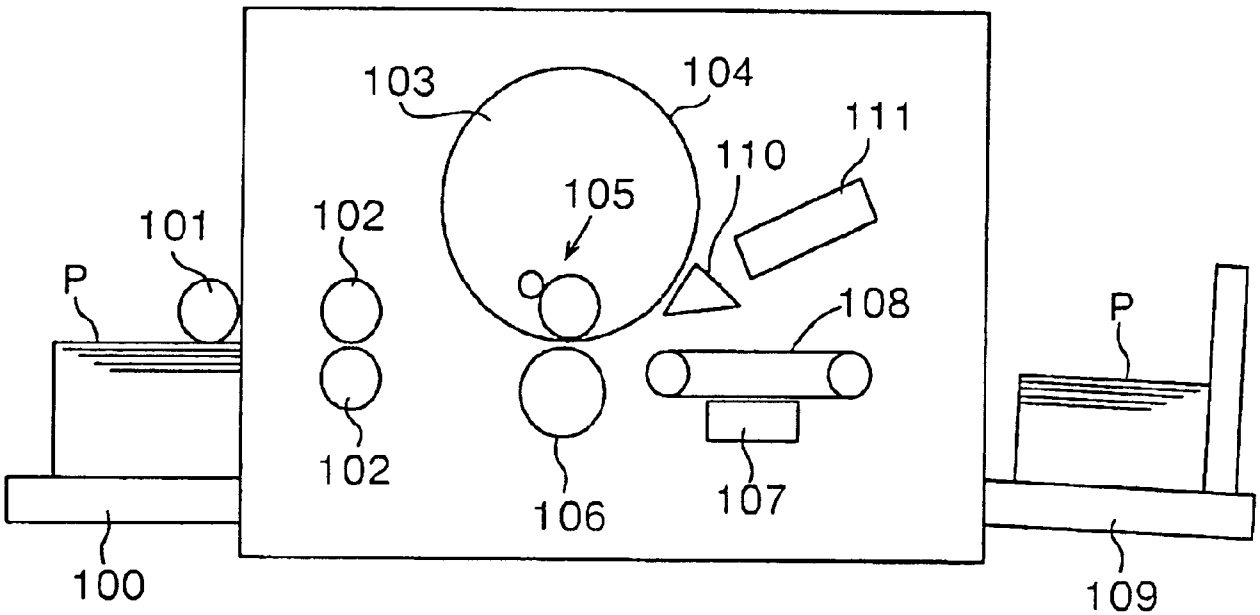
FIG. 21 Prior Art
FIG. 21 is a side view showing a conventional stencil printing machine.

In this case, the examples of the suction transfer means 25 of FIG. 2(*a*) through FIG. 4(*b*), becomes the exfoliation suction means 25A which are not provided with the vent holes 38 and the transfer suction ports 40 as shown by FIG. 16(*a*) through FIG. 18(*b*). Similarly, also the example of the suction transfer means 75 of FIG. 12 and FIG. 13, becomes the exfoliation suction means 75A which is not provided with the vent holes 88 and the transfer suction ports 90 as shown by FIG. 19 and FIG. 20.

As has been explained above, according to the stencil printing machine of the invention, at the exfoliation suction port, the suction force by the suction force generating portion constitutes the suction force for exfoliating the printed print sheet from the side of the printing drum. Thereby, with regard to exfoliation of the print sheet from the side of the printing drum, in place of the conventional constitution of the separating claw or the air blow fan, there is constructed the system of sucking the print sheet and therefore, the printed image face of the print sheet is not touched and the print quality of the image portion can be prevented from deteriorating.

Further, the exfoliation suction port is arranged to be proximate to the press roller on the lower side of the reference line. The reference line is orthogonal to the center line of the squeegee roller intersecting with the axis line of the printing drum and passes through the press contact position of the press roller and the side of the printing drum. Thereby, the suction force of the exfoliation suction port for exfoliating the print sheet from the side of the printing drum can efficiently be operated to the print sheet.

Particularly, by the exfoliation suction port, the suction force by the suction force generating portion constitutes the suction force for exfoliating the printed print sheet from the side of the printing drum. Further, by the transfer suction port, the suction force by the suction force generating portion, constitutes the suction force for adsorbing the print sheet to the side of the transfer belt. Further, the print sheet adsorbed to the transfer belt is discharged by rotating the transfer belt.

Thereby, there can be carried out both of exfoliation of the print sheet from the side of the printing drum and transfer of the print sheet to the sheet discharge side which have been carried out conventionally by separate constitutions, by the suction transfer means.

Further, by providing the suction force generating portion to be proximate to the side of the exfoliation suction port, the suction force of the exfoliation suction port can be increased and the suction force for exfoliating the printed print sheet from the side of the printing drum can be increased.

Thereby, exfoliation of the print sheet from the side of the printing drum can be carried out stably and efficiently and even when the printing rate of the printed image is large or deviated, there can be resolved drawbacks such as blot of the printed image, occurrence of gradation, setoff and sheet discharge jam and the like.

Further, the exfoliation suction port is provided at the upper end edge of the case constituting the side of the one end portion of the guide plate, the pulley disposed at the vicinity of the exfoliation suction port is arranged in the case, the transfer belt is hung around to enter inside of the case from the exfoliation suction port and the support shaft for hanging the transfer belt is provided at the opening portion of the exfoliation suction port.

Thereby, the exfoliation suction port can further be made to be proximate to the press contact portion of the printing drum and the press roller and the suction operation by the exfoliation suction port can sufficiently be achieved. Further, by the transfer belt extended to the opening portion of the exfoliation suction port, the printed print sheet exfoliated from the side of the printing drum can immediately be transferred by the transfer belt.

Further, by forming to reduce the total opening area of the transfer suction ports relative to the total opening area of the exfoliation suction ports, the suction force of the exfoliation suction port can be increased and the suction force for exfoliating the printed print sheet from the side of the printing drum can be increased.

Thereby, the print sheet can be exfoliated from the side of the printing drum stably and efficiently and even when the printing rate of the printed image is large or deviated, there can be resolved drawbacks such as blot of the printed image, occurrence of gradation, setoff and sheet discharge jam and the like.

Further, by the guide ribs provided at the exfoliation suction means, when the print speed or the sheet quality of the print sheet P is changed, the track of the print sheet P sucked by the exfoliation suction port is not changed and the shift is not caused at the position of the sheet front end of the print sheet P.

Further, when a plurality of the printing drums are provided via the suction transfer means, in transferring the print sheet from the printing drum at the initial stage to the printing drum at the post stage, the position of the sheet front end can be aligned without change. Thereby, relative shift of the printed image by the respective printing drums can be eliminated and printing at the accurate printing position can be carried out.

The stencil printing machine according to the invention is useful for a stencil printing machine capable of carrying out single-faced printing, double-faced printing or multiple color printing.

What is claimed is:

1. A stencil printing machine comprising:

at least one printing drum having an ink-permeable peripheral wall in a cylindrical shape and made rotatable around an axis line thereof;

a squeegee roller for supplying ink from an inner peripheral face of the peripheral wall;

a press roller provided at an outside of the printing drum for bringing a print sheet into press contact with a stencil sheet wound around an outer peripheral face of the peripheral wall between the squeegee roller and the press roller; and exfoliation suction means for sucking the print sheet so as to exfoliate the print sheet from the printing drum;

the exfoliation suction means comprising:

a case having a guide plate at an upper face thereof and an exfoliation suction port at one end portion of the guide plate, the exfoliation suction port being provided at an upper end edge of the case constituting the one end portion of the guide plate and arranged to be proximate to the press roller on a lower side of a reference line, the reference line being orthogonal to a center line of the squeegee roller intersecting with the axis line of the printing drum and passing through a position of bringing the press roller and the side of the printing drum into press contact with each other;

a suction force generating portion for generating suction force to suck the print sheet toward the exfoliation suction port so as to exfoliate the print sheet from the printing drum, the suction force generating portion being provided at the case; and a transfer section for transferring the print sheet having one pulley disposed at a vicinity of the exfoliation suction port in the case and axially supported by one end portion side of the guide plate; another pulley axially supported by another end portion side of the guide plate; a support shaft provided at an opening portion of the exfoliation suction port; and a transfer belt formed in an endless shape and hung around the pulleys and the support shaft so as to enter from the exfoliation suction port into the case so that an upper side portion of the transfer belt moves along an upper face of the guide plate.

2. The stencil printing machine according to claim 1:

wherein the suction force generating portion is provided to be proximate to a side of the exfoliation suction port.

3. A stencil printing machine comprising:

at least one printing drum having an ink-permeable peripheral wall in a cylindrical shape and made rotatable around an axis line thereof;

a squeegee roller for supplying ink from an inner peripheral face of the peripheral wall;

a press roller provided at an outside of the printing drum for bringing a print sheet into press contact with a stencil sheet wound around an outer peripheral face of the peripheral wall between the squeegee roller and the press roller; and exfoliation suction means for sucking the print sheet so as to exfoliate the print sheet from the printing drum;

the exfoliation suction means comprising:

a case having a guide plate at an upper face thereof and an exfoliation suction port at one end portion of the guide plate, the exfoliation suction port being arranged to be proximate to the press roller on a lower side of a reference line, the reference line being orthogonal to a center line of the squeegee roller intersecting with the axis line of the printing drum and passing through a position of bringing the press roller and the side of the printing drum into press contact with each other;

a suction force generating portion for generating suction force to suck the print sheet toward the exfoliation suction port so as to exfoliate the print sheet from the printing drum, the suction force generating portion being provided at the case;

a transfer section for hanging a transfer belt formed in an endless shape around a pair of pulleys axially supported by one end portion side and another end portion side of the guide plate so as to drive an upper side portion of the transfer belt along an upper face of the guide plate; and a guide rib for supporting the print sheet exfoliated from the side of the printing drum at the exfoliation suction port without bending the print sheet so as to guide the print sheet toward the transfer belt.

4. The stencil printing machine according to claim 1:

wherein a plurality of the printing drums are provided via the exfoliation suction means.

5. A stencil printing machine comprising:

at least one printing drum having an ink-permeable peripheral wall in a cylindrical shape and made rotatable around an axis line thereof;

a squeegee roller for supplying ink from an inner peripheral face of the peripheral wall;

a press roller provided at an outside of the printing drum for bringing a print sheet into press contact with a stencil sheet wound around an outer peripheral face of the peripheral wall between the squeegee roller and the press roller;

suction transfer means for sucking the print sheet so as to exfoliate the print sheet from the printing drum to thereby transfer the print sheet;

the suction transfer means comprising:

a case having a guide plate at an upper face thereof and an exfoliation suction port provided at one end portion of the guide plate, the exfoliation suction port being arranged to be proximate to the press roller on a lower side of a reference line, the reference line being orthogonal to a center line of the squeegee roller intersecting with the axis line of the printing drum and passing through a position of bringing the press roller and a side of the printing drum into press contact with each other;

a suction force generating portion for generating suction force, the suction force generating portion being provided at the case; and a transfer section for transferring the print sheet, the transfer section having:

one pulley disposed at a vicinity of the exfoliation suction port and axially supported by one end portion side of the guide plate;

another pulley axially supported by another end portion side of the guide plate; and an endless shaped transfer belt with a vent hole formed therein hung around the pulleys so as to enter from the exfoliation suction port into the case so that an upper side portion of the transfer belt moves along an upper face of the guide plate;

wherein the guide plate has a transfer suction port overlapping the vent hole of the transfer belt, and the suction force generating portion generates suction force for sucking the print sheet toward the exfoliation suction port so as to exfoliate the print sheet from the printing drum and for sucking the exfoliated print sheet toward the vent hole and the transfer suction port overlapping each other so as to adsorb the exfoliated print sheet onto the transfer belt.

6. The stencil printing machine according to claim 5:

wherein the suction force generating portion is provided to be proximate to a side of the exfoliation suction port.

7. The stencil printing machine according to claim 5:

wherein the exfoliation suction port is provided at an upper end edge of the case constituting the one end portion side of the guide plate, the one pulley is disposed in the case, the transfer section has a support shaft provided at an opening portion of the exfoliation suction port, and the transfer belt is hung around the pulleys and the support shaft so as to enter from the exfoliation suction port into the case.

8. The stencil printing machine according to claim 5:

wherein said stencil printing machine is formed such that a total opening area of the transfer suction port is smaller than a total opening area of the exfoliation suction port.

9. The stencil printing machine according to claim 5:

wherein the suction transfer means is provided with a guide rib for supporting the print sheet exfoliated from the side of the printing drum at the exfoliation suction port without bending the print sheet so as to guide the print sheet toward the transfer belt.

10. The stencil printing machine according to claim 5:

wherein a plurality of the printing drums are provided via the suction transfer means.

* * * * *